US006504490B2

(12) United States Patent
Mizushima

(10) Patent No.: US 6,504,490 B2
(45) Date of Patent: Jan. 7, 2003

(54) VEHICLE DETECTION APPARATUS AND VEHICLE DETECTION METHOD

(75) Inventor: Koichiro Mizushima, Kanagawa-ken (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/887,221

(22) Filed: Jun. 22, 2001

(65) Prior Publication Data

US 2002/0011939 A1 Jan. 31, 2002

(30) Foreign Application Priority Data

Jun. 22, 2000 (JP) ..... 2000-188125

(51) Int. Cl.[7] ..... G08G 1/04

(52) U.S. Cl. ..... 340/943; 340/934; 340/935; 340/936; 701/118; 701/119; 701/120

(58) Field of Search ..... 340/943, 935, 340/936, 934; 701/118, 119, 120

(56) References Cited

U.S. PATENT DOCUMENTS

| | | | | |
|---|---|---|---|---|
| 5,189,425 A | | 2/1993 | Dabbs | 340/952 |
| 5,619,616 A | * | 4/1997 | Brady et al. | 395/22 |
| 5,878,367 A | * | 3/1999 | Lee et al. | 340/943 |
| 6,094,150 A | * | 7/2000 | Ohnishi et al. | 340/943 |
| 6,195,608 B1 | * | 2/2001 | Berliner | 701/118 |

FOREIGN PATENT DOCUMENTS

| | | | |
|---|---|---|---|
| EP | 0 902 264 A2 | | 3/1999 |
| JP | 10192637 | * | 7/1998 |

OTHER PUBLICATIONS

Patent Abstracts of Japan, vol. 017, No. 422, Aug. 5, 1993 for Publ. No. 0581595, 1 page.
Patent Abstracts of Japan, vol. 018, No. 156, Mar. 15, 1994 for Publ. No. 05325090, 1 page.

* cited by examiner

*Primary Examiner*—Jeffery Hofsass
*Assistant Examiner*—Daniel Previl
(74) *Attorney, Agent, or Firm*—Pearne & Gordon LLP

(57) ABSTRACT

There are provided a vehicle detection apparatus and a vehicle detection method which are capable of detecting a sound source even when a plurality of vehicles are traveling simultaneously or when there are noises produced from something other than the desired vehicle and calculating the location in the vehicle traveling direction and the lane direction of the sound source and the number of passing vehicles. In the vehicle detection apparatus and the vehicle detection method, noises are collected by a microphone array (402) comprising a plurality of microphones arranged in the form of a matrix in the same plane, the outputs thereof are sampled periodically with time windows in a noise component matrix calculation section (122), the direction in the vehicle traveling direction and the lane direction of the sound source in each window is estimated in an α-direction calculation section (410) and a β-direction calculation section (417), the vehicle is detected by the degree of similarity between the estimated directions in the vehicle traveling direction and traveling sound templates in a vehicle detection section (124), and the estimated directions in the lane direction are counted for each lane and the location in the lane direction of the sound source is detected in a lane detection section (312).

27 Claims, 16 Drawing Sheets

VEHICLE DETECTION APPARATUS AND VEHICLE DETECTION METHOD

BACKGROUND OF THE INVENTION

1. Field of the Invention

The present invention relates to a vehicle detection apparatus and a vehicle detection method which can detect a desired vehicle by using a microphone array.

2. Description of the Related Art

There have so far been proposed a wide variety of apparatuses for detecting the state of traffic flow from the noises produced by vehicles, and such proposed apparatuses include those intended for reducing the sizes and costs of the apparatuses. An exemplified apparatus is shown in FIG. 16, as comprising sound collectors 701 and 702, amplifying circuits 703 and 704, a switching circuit 705, a frequency analyzing circuit 706, a frequency distribution comparing circuit 707, a time difference detecting circuit 708, a time difference/velocity converting circuit 709, a timing controlling circuit 710 and a velocity display outputting circuit 711 and determines the velocity of traffic flow by measuring noises at the two spots along and in the vicinity of a road where traffic flows (Japanese Patent Application Laid-Open No. 114098/1993).

In FIG. 16, the first sound collector 701 and the second sound collector 702 are placed along traffic flow with a fixed distance L therebetween. The noises A and B of the traffic flow which have been collected by these sound collectors 701 and 702 are in turn inputted to the frequency analyzing circuit 706 by switching the switching circuit 705 alternately, and their frequencies are in turn analyzed by the frequency analyzing circuit 706, to ensure that frequency spectral distributions SA and SB are obtained.

Then, the degree of similarity between the frequency spectral distribution SA and the frequency spectral distribution SB is detected by the frequency distribution comparing circuit 707, and the time difference between the frequency spectral distribution SA and the frequency spectral distribution SB which nearly match with each other is determined by the time difference detecting circuit 708. The time difference/velocity converting circuit 709 determines the velocity V of a noise source (vehicle) by performing the computation represented by the expression "V=L/dt". In this case, the direction in which the vehicle in headed can be calculated from the calculated time difference.

However, such a conventional detection apparatus has the problem that the accuracy of detecting a vehicle lowers when a plurality of vehicles are traveling simultaneously or when there are noises produced from something other than a desired vehicle because, as described above, the conventional detection apparatus measures noises only at the two spots along and in the vicinity of a road where traffic flows and calculates the velocity and traveling direction of the vehicle based on the time difference between the frequency spectral distribution SA and the frequency spectral distribution SB which nearly match with each other.

SUMMARY OF THE INVENTION

It is an object of the present invention to provide a vehicle detection apparatus which is capable of detecting a sound source even when a plurality of vehicles are traveling simultaneously or when there are noises produced from something other than the desired vehicle and calculating the location in the vehicle traveling direction and the lane direction of the vehicle and the number of passing vehicles.

It is another object of the present invention to provide a vehicle detection method which is capable of detecting a sound source even when a plurality of vehicles are traveling simultaneously or when there are noises produced from something other than the desired vehicle and calculating the location in the vehicle traveling direction and the lane direction of the vehicle and the number of passing vehicles.

In accordance with a first aspect of the present invention, there is provided a vehicle detection apparatus which comprises a sound collection means comprising a plurality of microphones and placed in the vicinity of a road; a direction estimation means for sampling the input signals from the sound collection means periodically with time windows and estimating the direction of a sound source in each time window; and a similarity calculation means for calculating the degree of similarity between the estimation results by the direction estimation means and a plurality of templates which indicate a change in the location of the sound source with time while the vehicle is traveling. According to this constitution, a change in the location of the vehicle with time is detected by calculating the above degree of similarity, whereby the vehicle is detected.

In the aforesaid vehicle detection apparatus according to the present invention, the above sound collection means comprises a plurality of microphones aligned on a line parallel to the vehicle traveling direction. According to this constitution, the location in the vehicle traveling direction of a vehicle is detected.

In the aforesaid vehicle detection apparatus according to the present invention, the above sound collection means comprises a plurality of microphones aligned on a line parallel to the vehicle traveling direction and a plurality of microphones aligned on a line perpendicular to the vehicle traveling direction. According to this constitution, the location in the vehicle traveling direction and the lane direction of a vehicle is detected.

In the aforesaid vehicle detection apparatus according to the present invention, the above sound collection means comprises a plurality of microphones aligned on a line parallel to the vehicle traveling direction and a plurality of microphones aligned on a line perpendicular to the vehicle traveling direction. According to this constitution, the location in the vehicle traveling direction and the lane direction of a vehicle is detected. In this case, the above direction estimation means comprises an estimation means for estimating the location in the vehicle traveling direction and the lane direction of the sound source.

In the aforesaid vehicle detection apparatus according to the present invention, the above sound collection means comprises a plurality of microphones aligned on a line parallel to the vehicle traveling direction and a plurality of microphones aligned on a line perpendicular to the vehicle traveling direction. According to this constitution, the location in the vehicle traveling direction and the lane direction of a vehicle is detected. In this case, when the above road has a plurality of lanes, the vehicle detection apparatus according to the present invention comprises counters for counting the estimation results by the above direction estimation means for each lane and a lane detection means for detecting the location in the lane direction of the sound source based on the counting values of these counters.

In the aforesaid vehicle detection apparatus according to the present invention, the above sound collection means comprises a plurality of microphones arranged in the form of a matrix in the same plane. According to this constitution, even when a plurality of vehicles are traveling simultaneously, the microphones arranged in the form of a matrix identifies a sound source precisely and detects the location in the vehicle traveling direction and the lane direction of the vehicle while the deterioration of the accuracy of the detection by other noises is suppressed.

In the aforesaid vehicle detection apparatus according to the present invention, the above direction estimation means comprises an estimation means for estimating the two-dimensional direction in the vehicle traveling direction and the lane direction of a sound source. According to this constitution, the location in the vehicle traveling direction and the lane direction of the vehicle can be detected while the deterioration of the accuracy of the detection by other noises is suppressed more securely, as compared with, for example, the case where microphones are aligned in the x-axis and z-axis directions to set only an $\alpha$ direction (lane direction) or a $\beta$ direction (vehicle traveling direction).

In the aforesaid vehicle detection apparatus according to the present invention, the above direction estimation means comprises an estimation means for estimating the direction in the vehicle traveling direction and the lane direction of a sound source two-dimensionally. According to this constitution, the location in the vehicle traveling direction and the lane direction of the vehicle can be detected while the deterioration of the accuracy of the detection by other noises is suppressed more securely, as compared with, for example, the case where microphones are aligned in the x-axis and z-axis directions to set only an $\alpha$ direction (lane direction) or a $\beta$ direction (vehicle traveling direction). In this case, the above direction estimation means comprises an estimation means for estimating the direction of a sound source by scanning in the vehicle traveling direction with the direction of the sound source in the lane direction limited to the center of the road.

In the aforesaid vehicle detection apparatus according to the present invention, the above direction estimation means comprises an estimation means for estimating the direction in the vehicle traveling direction and the lane direction of a sound source two-dimensionally. According to this constitution, the location in the vehicle traveling direction and the lane direction of the vehicle can be detected while the deterioration of the accuracy of the detection by other noises is suppressed more securely, as compared with, for example, the case where microphones are aligned in the x-axis and z-axis directions to set only an $\alpha$ direction (lane direction) or a $\beta$ direction (vehicle traveling direction). In this case, the above direction estimation means comprises an estimation means for estimating the direction of a sound source by scanning in the lane direction with the direction of the sound source in the vehicle traveling direction limited.

In the aforesaid vehicle detection apparatus according to the present invention, when the above road has a plurality of lanes, comprises a first counter which counts the estimation results by the above direction estimation means for each lane, a lane location detection means for detecting the location in the lanes of a sound source based on the counting values of this counter, and a second counter which counts the detection results by this lane location detection means for each lane. According to this constitution, passing vehicles are counted for each lane by the above second counter.

In the aforesaid vehicle detection apparatus according to the present invention, the above similarity calculation means comprises a comparison means for comparing the above plurality of templates with the estimation results. According to this constitution, the traveling velocity of a vehicle is calculated by using the templates (plurality of templates) at different velocities.

In the aforesaid vehicle detection apparatus according to the present invention, the above similarity calculation means comprises a comparison means for comparing the above plurality of templates with the estimation results. According to this constitution, the traveling velocity of a vehicle is calculated by using the templates (plurality of templates) at different velocities. In this case, the above plurality of templates are preferably those prepared by using the sounds of a vehicle when the vehicle is caused to travel at different velocities.

In the aforesaid vehicle detection apparatus according to the present invention, the above similarity calculation means comprises a comparison means for comparing the above plurality of templates with the estimation results. According to this constitution, the traveling velocity of a vehicle is calculated by using the templates (plurality of templates) at different velocities. In this case, the above plurality of templates are preferably those prepared by expanding or contracting the time base of a template prepared by using the sound of a vehicle traveling at a constant velocity, and the above similarity calculation means comprises a time-base expansion means for expanding or contracting the above time base of the template.

In the aforesaid vehicle detection apparatus according to the present invention, the above sound collection means comprises a plurality of microphones the number of which is equal to or greater than "number of assumed sound sources+1". According to this constitution, the accuracy of estimating the direction of a sound source improves, and the vehicle can still be detected even when a plurality of vehicles are traveling simultaneously or when there are noises produced from something other than the desired vehicle.

In accordance with a second aspect of the present invention, there is provided a vehicle detection method which comprises a sound collection step in which the noises produced by a traveling vehicle are collected by a plurality of microphones placed in the vicinity of a road; a direction estimation step in which the input signals from the above plurality of microphones are sampled periodically with time windows and the direction of a sound source is estimated in each time window; and a similarity calculation step in which the degree of similarity between the estimation results by this direction estimation step and templates which indicate a change in the direction of the sound source with time while the vehicle is traveling is calculated. According to this method, a change in the location of the vehicle with time is detected by calculating the above degree of similarity, whereby the vehicle is detected.

The aforesaid vehicle detection method according to the present invention may comprises a sound collection step in which the noises produced by a traveling vehicle are collected by a plurality of microphones aligned on a line parallel to the vehicle traveling direction and placed in the vicinity of a road; a direction estimation step in which the input signals from the above plurality of microphones are sampled periodically with time windows and the direction of a sound source is estimated in each time window; and a vehicle detection step in which the degree of similarity between the estimation results by this direction estimation step and a plurality of templates which indicate a change in the direction of the sound source with time while the vehicle is traveling is calculated and the vehicle is detected based on the result of the calculation. According to this method, a change in the location in the vehicle traveling direction of the vehicle with time is detected by calculating the above degree of similarity, whereby the vehicle is detected, and the traveling velocity of the vehicle is calculated by using the templates (plurality of templates) at different velocities.

The aforesaid vehicle detection method according to the present invention may comprises a sound collection step in which the noises produced by a traveling vehicle are collected by a plurality of microphones aligned on a line parallel to the vehicle traveling direction and on a line perpendicular to the vehicle traveling direction and placed in the vicinity of a road; a direction estimation step in which the input signals from the above plurality of microphones are sampled periodically with time windows and the direction in the vehicle traveling direction and the lane direction of a sound source is estimated in each time window; a vehicle detection step in which the degree of similarity between the estimation results in the vehicle traveling direction by this direction estimation step and a plurality of templates which indicate a change in the direction of the sound source with time while the vehicle is traveling is calculated and the vehicle is detected based on the result of the calculation; and a lane detection step in which the estimation results in the lane direction by the above direction estimation step are counted for each lane and the location in the lanes of the sound source is detected based on the counting values. According to this method, the location in the traveling direction and the lane direction of the vehicle is detected.

The aforesaid vehicle detection method according to the present invention may comprises a sound collection step in which the noises produced by a traveling vehicle are collected by a plurality of microphones arranged in the form of a matrix in the same plane and placed in the vicinity of a multi-lane road; a direction estimation step in which the input signals from the above plurality of microphones are sampled periodically with time windows and the two-dimensional direction in the vehicle traveling direction and the lane direction of a sound source is estimated in each time window; a vehicle detection step in which the degree of similarity between the estimation results in the vehicle traveling direction by this direction estimation step and a plurality of templates which indicate a change in the direction of the sound source with time while the vehicle is traveling is calculated and the vehicle is detected based on the result of the calculation; and a lane detection step in which the estimation results in the lane direction by the above direction estimation step are counted for each lane and the location in the lanes of the sound source is detected based on the counting values. According to this method, the location in the vehicle traveling direction and the lane direction of the vehicle can be detected while the deterioration of the accuracy of the detection by other noises is suppressed more securely, as compared with, for example, the case where microphones are aligned in the x-axis and z-axis directions to set only an $\alpha$ direction (lane direction) or a $\beta$ direction (vehicle traveling direction).

The aforesaid vehicle detection method according to the present invention may comprises a sound collection step in which the noises produced by a traveling vehicle are collected by a plurality of microphones arranged in the form of a matrix in the same plane and placed in the vicinity of a multi-lane road; a direction estimation step in which the input signals from the above plurality of microphones are sampled periodically with time windows and the two-dimensional direction in the vehicle traveling direction and the lane direction of a sound source is estimated in each time window; a vehicle detection step in which the degree of similarity between the estimation results in the vehicle traveling direction by this direction estimation step and a plurality of templates which indicate a change in the direction of the sound source with time while the vehicle is traveling is calculated and the vehicle is detected based on the result of the calculation; and a lane detection step in which the estimation results in the lane direction by the above direction estimation step are counted for each lane and the location in the lanes of the sound source is detected based on the counting values. According to this method, the location in the vehicle traveling direction and the lane direction of the vehicle can be detected while the deterioration of the accuracy of the detection by other noises is suppressed more securely, as compared with, for example, the case where microphones are aligned in the x-axis and z-axis directions to define only an $\alpha$ direction (lane direction) or a $\beta$ direction (vehicle traveling direction). In this case, in the above direction estimation step, the direction of the sound source is estimated by scanning in the vehicle traveling direction with the direction of the sound source in the lane direction limited to the center of the road.

The aforesaid vehicle detection method according to the present invention may comprises a sound collection step in which the noises produced by a traveling vehicle are collected by a plurality of microphones arranged in the form of a matrix in the same plane and placed in the vicinity of a multi-lane road; a direction estimation step in which the input signals from the above plurality of microphones are sampled periodically with time windows and the two-dimensional direction in the vehicle traveling direction and the lane direction of a sound source is estimated in each time window; a vehicle detection step in which the degree of similarity between the estimation results in the vehicle traveling direction by this direction estimation step and a plurality of templates which indicate a change in the direction of the sound source with time while the vehicle is traveling is calculated and the vehicle is detected based on the result of the calculation; and a lane detection step in which the estimation results in the lane direction by the above direction estimation step are counted for each lane and the location in the lanes of the sound source is detected based on the counting values. According to this method, the location in the vehicle traveling direction and the lane direction of the vehicle can be detected while the deterioration of the accuracy of the detection by other noises is suppressed more securely, as compared with, for example, the case where microphones are aligned in the x-axis and z-axis directions to set only an $\alpha$ direction (lane direction) or a $\beta$ direction (vehicle traveling direction). In this case, in the above direction estimation step, the direction of the sound source is estimated by scanning in the lane direction with the direction of the sound source in the vehicle traveling direction limited.

The aforesaid vehicle detection method according to the present invention may comprises a sound collection step in which the noises produced by a traveling vehicle are collected by a plurality of microphones arranged in the form of a matrix in the same plane and placed in the vicinity of a multi-lane road; a direction estimation step in which the input signals from the above plurality of microphones are sampled periodically with time windows and the two-dimensional direction in the vehicle traveling direction and the lane direction of a sound source is estimated in each time window; and a lane-specific vehicle detection step in which the estimation results in the lane direction by this direction estimation step are counted for each lane to carry out vehicle detection and detected vehicles are counted for each lane. According to this method, passing vehicles are counted for each lane while the deterioration of the accuracy of the detection by other noises is suppressed more securely, as compared with, for example, the case where microphones are aligned in the x-axis and z-axis directions to set only an α direction (lane direction) or a β direction (vehicle traveling direction).

The aforesaid vehicle detection method according to the present invention may comprises a sound collection step in which the noises produced by a traveling vehicle are collected by a plurality of microphones arranged in the form of a matrix in the same plane and placed in the vicinity of a multi-lane road; a direction estimation step in which the input signals from the above plurality of microphones are sampled periodically with time windows and the two-dimensional direction in the vehicle traveling direction and the lane direction of a sound source is estimated in each time window; and a lane-specific vehicle detection step in which the estimation results in the lane direction by this direction estimation step are counted for each lane to carry out vehicle detection and detected vehicles are counted for each lane. According to this method, passing vehicles are counted for each lane while the deterioration of the accuracy of the detection by other noises is suppressed more securely, as compared with, for example, the case where microphones are aligned in the x-axis and z-axis directions to set only an α direction (lane direction) or a β direction (vehicle traveling direction). In this case, in the above direction estimation step, the direction of the sound source is estimated by scanning in the lane direction with the direction of the sound source in the vehicle traveling direction limited.

In the above vehicle detection step of the aforesaid vehicle detection method according to the present invention, the degree of similarity between the templates prepared by using the sounds of a vehicle traveling at different velocities and the above estimation results in the above vehicle detection step is calculated. According to this method, a change in the location in the vehicle traveling direction of the vehicle with time is detected by calculating the above degree of similarity, whereby the vehicle is detected, and the traveling velocity of the vehicle is calculated by using the templates (plurality of templates) at different velocities.

In the vehicle detection method according to the present invention, the above vehicle detection step further comprises a velocity detection step in which the degree of similarity between the templates prepared by expanding or contracting the time base of a template prepared by using the sounds of a vehicle traveling at a constant speed and the above estimation results is calculated and, according to the result of the calculation, the velocity of the detected vehicle is calculated from the expansion ratio of the template and the vehicle velocity used for preparing the template. According to this method, a change in the location in the vehicle traveling direction of the vehicle with time is detected by calculating the above degree of similarity, whereby the vehicle is detected, and the traveling velocity of the vehicle is calculated by using the templates (plurality of templates) at different velocities.

In the aforesaid vehicle detection method according to the present invention, template matching is used to calculate the degree of similarity between the above templates and the estimation results. According to this method, a change in the location of the vehicle with time is detected by calculating the above degree of similarity, whereby the vehicle is detected. A change in the location of the vehicle with time is detected by calculating the above degree of similarity, whereby the vehicle is detected in the vehicle traveling direction.

In the aforesaid vehicle detection method according to the present invention, DP matching is used to calculate the degree of similarity between the templates and the estimation results. According to this method, a change in the location of the vehicle with time is detected by calculating the above degree of similarity, whereby the vehicle is detected. A change in the location of the vehicle with time is detected by calculating the above degree of similarity, whereby the vehicle is detected in the vehicle traveling direction.

In the aforesaid vehicle detection method according to the present invention, the number of the above plurality of microphones is equal to or greater than "number of assumed sound sources+1". According to this method, the accuracy of estimating the direction of a sound source improves, and a vehicle is detected even when a plurality of vehicles are traveling simultaneously or when there are noises produced from something other than the desired vehicle.

BRIEF DESCRIPTION OF THE DRAWINGS

The Present invention and many of the advantages thereof will be better understood from the following detailed description when considered in connection with the accompanying drawings, wherein.

DESCRIPTION OF THE PREFERRED EMBODIMENTS

The embodiments according to the present invention will be described with reference to the drawings hereinafter.

[First Embodiment]

Figure 1:
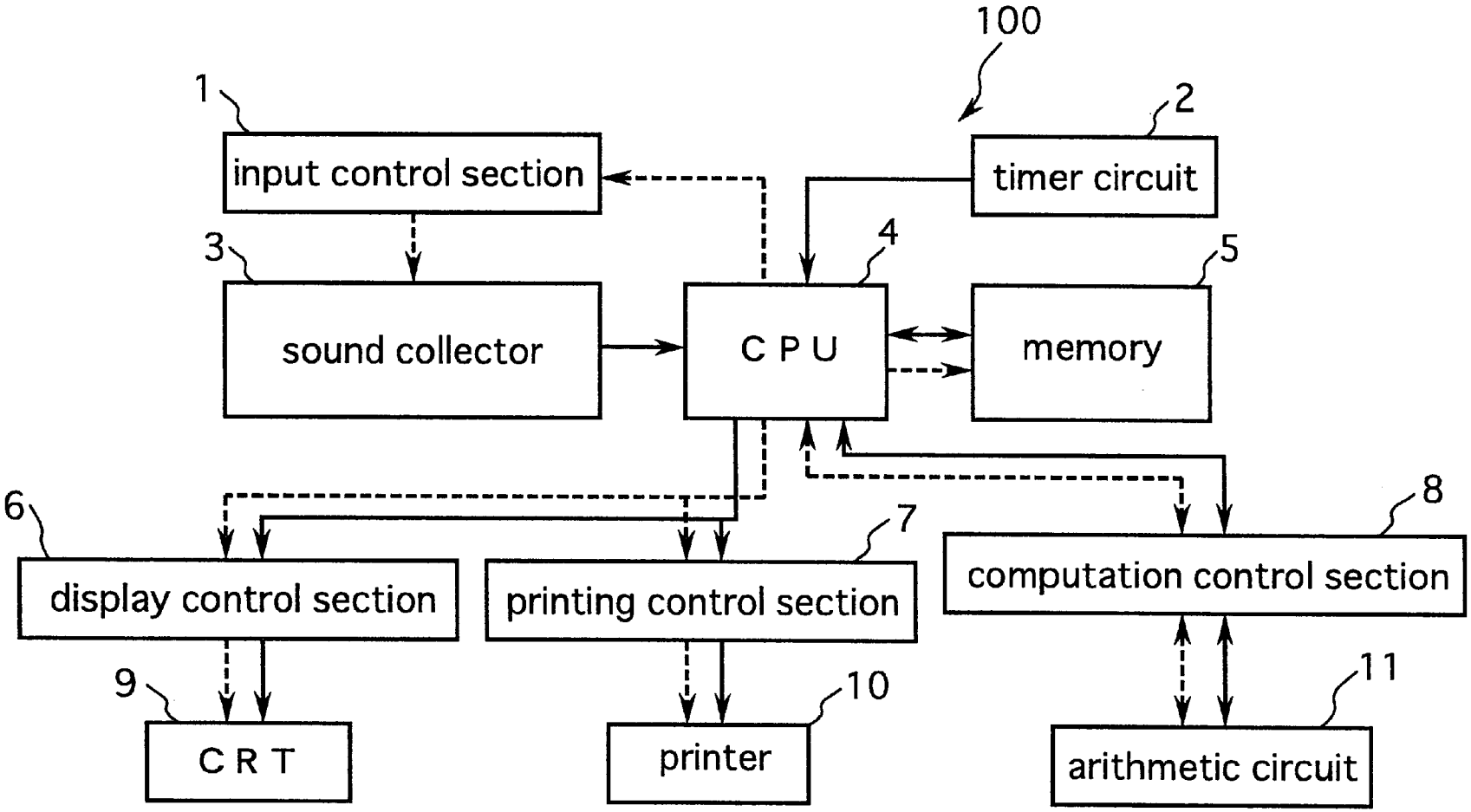
FIG. 1 is a block diagram showing the vehicle detection apparatus 100 of the first embodiment.

As shown in FIG. 1, the vehicle detection apparatus 100 of the first embodiment according to the present invention comprises a CPU 4 and a memory 5 which control the whole detection apparatus, a sound collector 3 which collects the noises produced by a traveling vehicle, an input control section 1 which controls the driving of the sound collector 3 (including the rotation of a microphone array 102 to be described later), an arithmetic circuit 11 which performs a variety of computations such as those for calculating noise components, for calculating the estimated direction of a noise source and for detecting the vehicle, an arithmetic control section 8 which controls the driving of the arithmetic circuit 11, a CRT 9 and a display control section 6 which display the result of detection, a printer 10 and a printing control section 7 which print the result of detection, and a timer circuit 2 which is used for measuring time.

Figure 2:
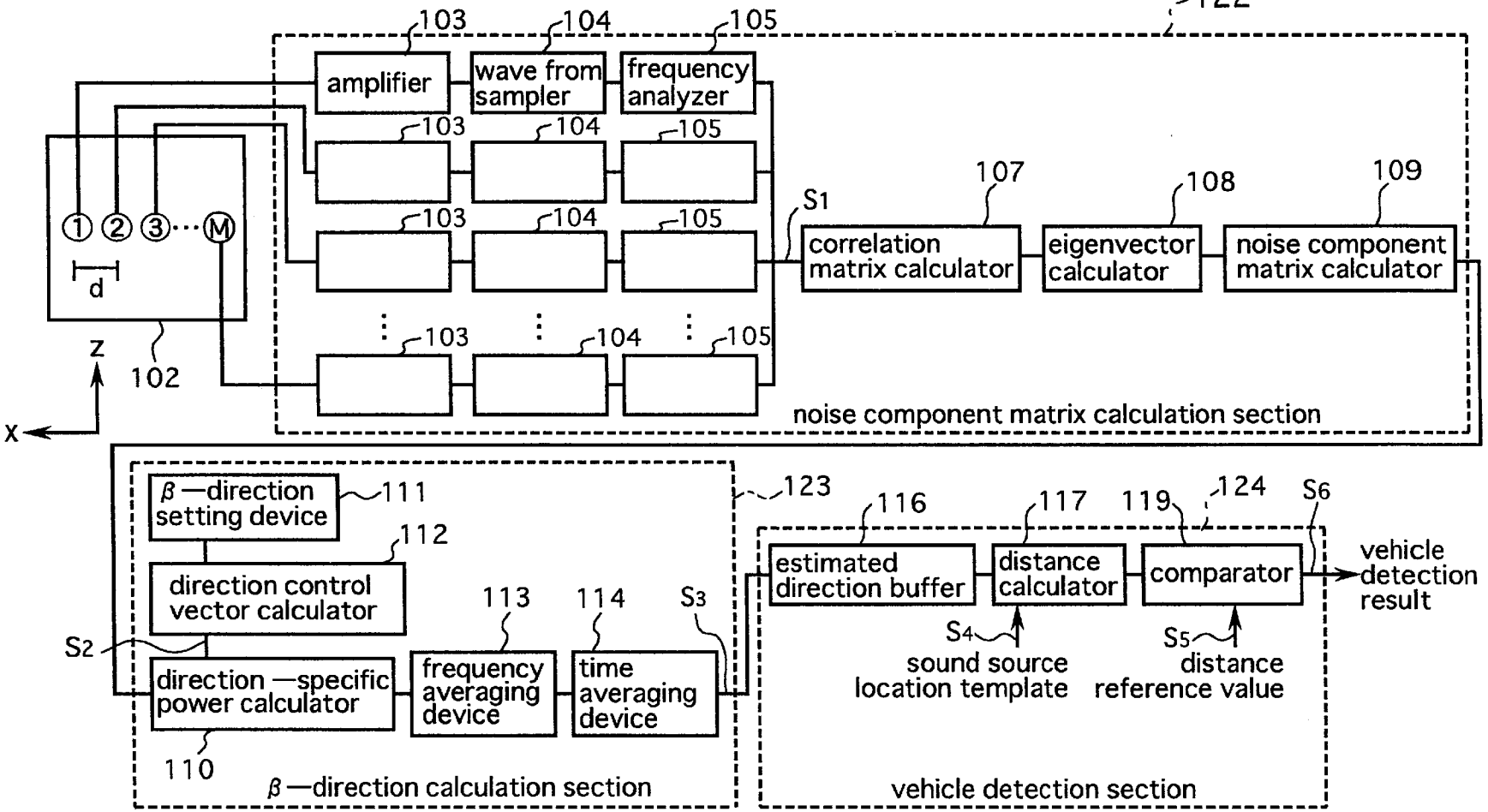
FIG. 2 is a block diagram showing the substantial part of the vehicle detection apparatus of the first embodiment according to the present invention.
Figure 3:
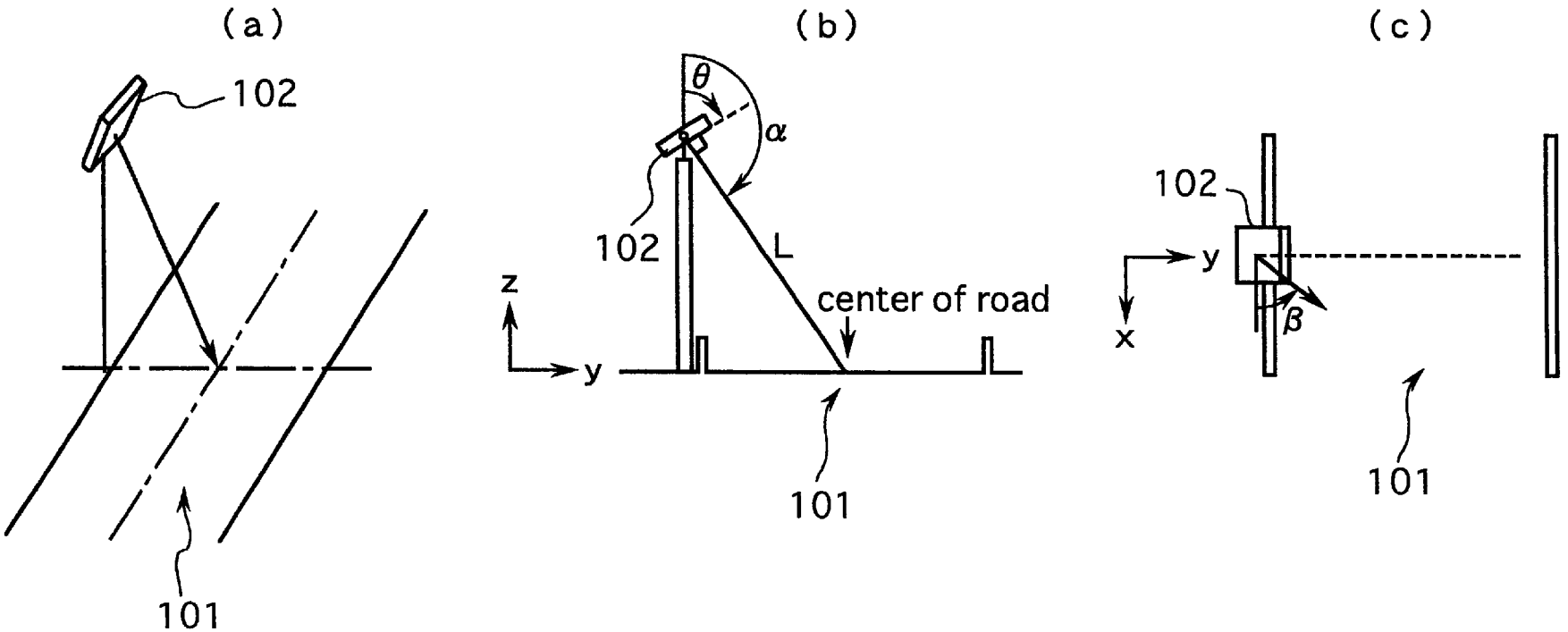
FIG. 3 is a diagram showing the placement of the microphone array of the first embodiment according to the present invention.

As shown in FIGS. 2 and 3, the above vehicle detection apparatus 100 comprises a microphone array 102 comprising M (M>2) number of microphones, a β-direction noise component matrix calculation section 122 which receives the outputs of the microphone array 102 and calculates the noise components in the outputs, a β-direction calculation section 123 which receives the output of the 3-direction noise component matrix calculation section 122 and calculates the estimated β direction of a sound source, and a vehicle detection section 124 which detects a vehicle traveling on the road 101, in its substantial part comprising the sound collector 3, the CPU 4, the memory 5 and the arithmetic circuit 11.

As shown in FIG. 3(*a*), the microphone array 102 is placed on a line parallel to the vehicle traveling direction of the road 101, and the above M number of microphones are aligned on the above line at a regular interval d. This interval between the microphones is not necessarily constant. In this case, however, it is set to be a regular interval d because the calculation of a direction control vector in the β-direction calculation section 123 is facilitated. This interval d must be made shorter than a half of the wavelength of a target sound source signal and, within the range, the accuracy of estimating the direction of a sound source increases as the value of the interval d increases. When a target sound source is a vehicle, although frequency characteristics vary from vehicle to vehicle, since many different types of vehicles produce a sufficient power in the range of 500 Hz to 3 kHz, the interval d between the microphones is desirably 5 to 34 cm in order to detect the direction of the sound source within the above range. Particularly, when the interval d is set to be 5 to 10 cm, the size of the sensor can be decreased. Further, to improve the accuracy of estimating the direction of a sound source, the number M of microphones is desirably equal to or greater than "assumed number of sound sources (vehicles)+1". Particularly, in the case of a one-lane road, M is suitably 3 or 4 and, in the case of a multi-lane road, M is suitably "number of lanes+1" to "number of lanes×2".

As shown in FIG. 3(*b*), the microphone array 102 is configured such that it can be rotated in a vertical direction. The normal extended from the plane on which the microphone array 102 is placed forms an angle α with the z axis and is set to cross the center of the road. Further, as shown in FIG. 3(*c*), the microphone array 102 is configured such that it can also be rotated in a horizontal direction and that the direction of noises (vehicle) is estimated by an angle P formed by the normal extended from the plane on which the microphone array 102 is placed and the x axis.

The β-direction noise component matrix calculation section 122 comprises M number of amplifiers 103 which are connected to the microphone array 102 and receive the outputs of the microphones of the microphone array 102, M number of waveform samplers 104 which are connected to the M number of amplifiers 103 and receive the outputs of the corresponding amplifiers 103, M number of frequency analyzers 105 which are connected to the M number of waveform samplers 104 and receive the outputs of the corresponding waveform samplers 104, a correlation matrix calculator 107 which is connected to the M number of frequency analyzers 105 and receives the output (complex amplitude matrix) $S_1$ of the frequency analyzers 105, an eigenvector calculator 108 which is connected to the correlation matrix calculator 107, and a noise component matrix calculator 109 which is connected to the eigenvector calculator 108.

Further, the β-direction calculation section 123 comprises a β-direction setting device 111 which sets the β direction in scanning the microphone array 102, a direction vector calculator 112 which is connected to the β-direction setting device 111, a direction-specific power calculator 110 which is connected to the direction vector calculator 112 and to the β-direction noise component matrix calculation section 122 (noise component matrix calculator 109), a frequency averaging device 113 which is connected to the direction-specific power calculator 110, and a time averaging device 114 which is connected to the frequency averaging device 113. The output (estimated β direction) $S_3$ of the β-direction calculation section 123 is obtained, via the frequency averaging device 113 and the time averaging device 114, from the above direction-specific power calculator 110.

Further, the vehicle detection section 124 comprises an estimated direction buffer 116 which is connected to the β-direction calculation section 123, a distance calculator 117 which is connected to the estimated direction buffer 116 and receives a preset sound source location template $S_4$, and a comparator 119 which is connected to the distance calculator 117 and receives a preset distance reference value $S_5$. The output $S_6$ of the comparator 119 is the result of vehicle detection (the output of the vehicle detection section 124).

Next, a vehicle detection method based on the above vehicle detection apparatus 100 will be described.

Figure 4:
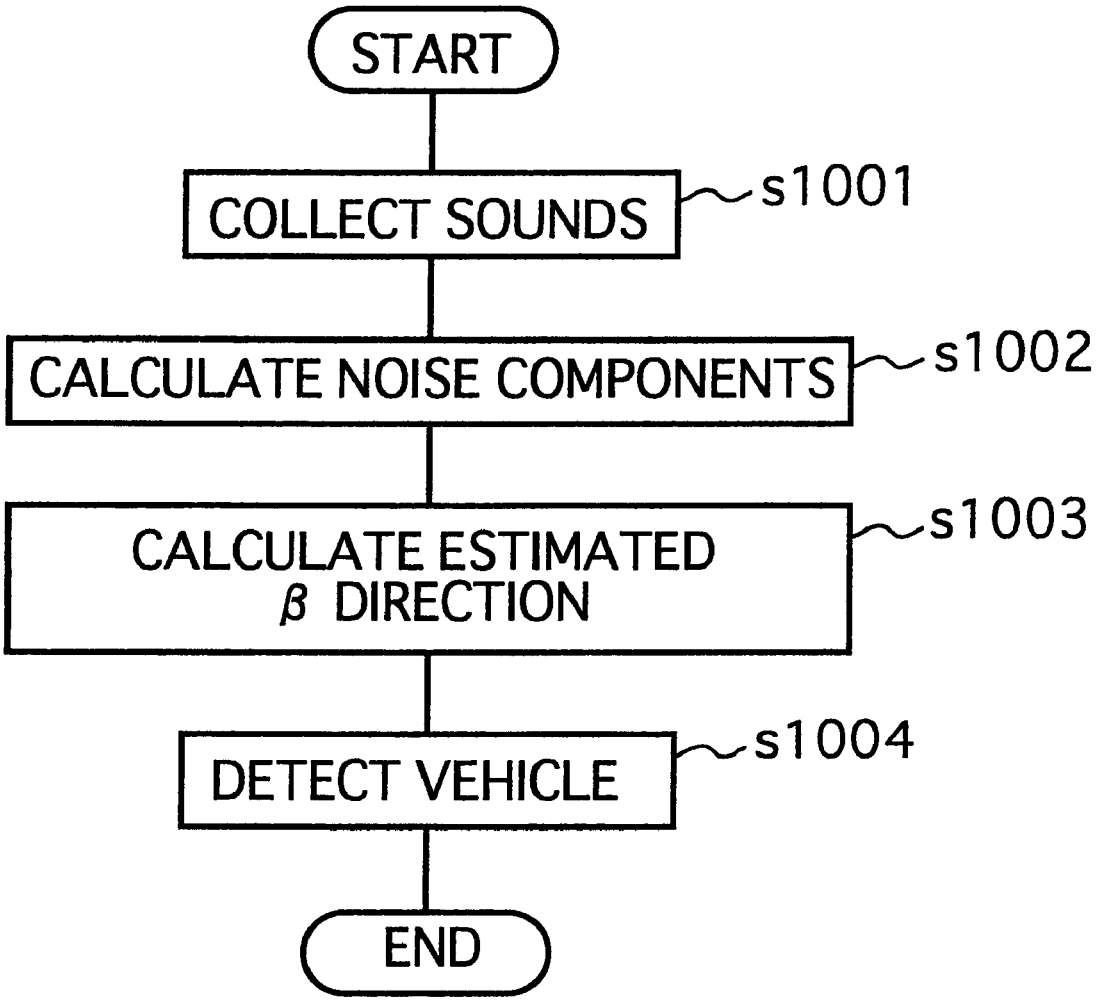
FIG. 4 is a flow chart showing the vehicle detection method of the first embodiment according to the present invention.

As shown in FIG. 4, the vehicle detection method according to the present embodiment comprises a sound collection step (s1001), a noise component calculation step (s1002), an estimated β direction calculation step (s1003) and a vehicle detection step (s1004).

In the sound collection step (s1001), the microphone array 102 is controlled by the above input control section 1 to collect the noises produced by the vehicles and the like on the road 101, and the outputs of the microphone array 102 are amplified by the amplifiers 103.

In the noise component calculation step (s1002), after the outputs of the microphone array 102 are amplified by the amplifiers 103, the amplified outputs are inputted to the waveform samplers 104 and sampled periodically with a time window having a window length W.

Although the shape of the time window may be a rectangle, a time window having small amplitudes at both ends, such as a Hanning window, is more preferable. As for the window length W, a shorter window length W further deteriorates the accuracy of direction estimation, while a longer window length W is more liable to fail to track the sudden movement of a sound source. Therefore, an optimum window length W must be selected according to the traveling velocity of a target sound source. For example, when the direction of a vehicle passing the position which is away from the microphone array 102 at a distance L of 10 m at a velocity of about 40 km/hr is to be estimated, the time window length W is suitably 2 to 10 ms. The period of sampling by the time window is suitably W/2 to 2 W.

For the time signals thus-sampled in the waveform samplers 104, a complex amplitude for each frequency is calculated in the frequency analyzers 105. As a method for calculating the complex amplitude, a method based on known fast Fourier transform (FFT) is appropriate. However, when the number of frequencies for which the complex amplitudes are calculated is equal to or less than four, a method based on known discrete Fourier transform (DFT) is appropriate. As for the above frequencies, the accuracy of direction estimation increases as they become higher so long as they are lower than a frequency whose wavelength is twice as long as the distance d in the microphone array 102. Therefore, practically, frequencies having a wavelength of not shorter than c/10d, in which c represents a sound velocity, and shorter than c/2d, in which c is the same as defined above, are appropriate. A complex amplitude matrix $S_1$ is calculated for a certain frequency and is expressed as a column vector X[m] as shown by (expression 1)

$$X[m]=[x_1,x_2,\ldots,x_M]^T \quad \text{(expression 1)}$$

In the above expression, $x_m$ (m=1 to M) represents a complex amplitude for the frequency, which is calculated from the input signal from the $m_{th}$ microphone. In addition, the letter T indicates the transposed matrix of the matrix [·].

Then, in the correlation matrix calculator 107, a correlation matrix is calculated from the output (complex amplitude matrix) $S_1$ of the M number of frequency analyzers 105 by (expression 2) and expressed by the matrix R[m,m]

$$R[m,m]=X[m]\cdot X[m]^H \quad \text{(expression 2)}$$

In the above expression, the letter H indicates a transposed complex conjugate, and m is 1 to M.

Then, in the eigenvector calculator 108, the eigenvectors $v_1[m]$, $v_2[m]$, $v_M[m]$ (m=1 to M) of the above matrix R[m,m] are calculated. To calculate the above eigenvectors, since the above matrix R is a Hermitian matrix, it is firstly converted to a tridiagonal matrix by a known Householder's method, and the eigenvectors are then calculated by using a known QR method.

Then, in the noise component matrix calculator 109, the matrix Rn[m,m] corresponding to the noise components when there are K number of sound sources is calculated as shown by (expression 3).

$$Rn[m,m]=v_{K+1}[m]v_{K+1}[m]^H+v_{K+2}[m]v_{K+2}[m]^H+\ldots+v_M[m]v_M[m]^H \quad \text{(expression 3)}$$

In the above expression, the number K of sound sources must be not larger than "the number M of microphones−1", and when the number of sound sources cannot be estimated in advance, it is set to be "K=M−1". The noise component matrix Rn thus calculated is outputted from the β-direction noise component matrix calculation section 122 and inputted to the β-direction calculation section 123. The noise component calculation step (s1002) proceeds as described above.

In the estimated β direction calculation step (s1003), firstly, a desired β is set in the β-direction setting device 111 of the β-direction calculation section 123. Then, in the direction control vector calculator 112, using the above β, a direction control vector $S_2$ is expressed as a column vector d[m] as shown by (expression 4).

$$d[m]=[1,e^{-j\omega\tau},e^{-j\omega 2\tau},\ldots,e^{-j\omega(M-1)\tau}]^T \quad \text{(expression 4)}$$

In the above expression, τ is defined by (expression 5).

$$\tau=(d\sin\beta)/c \quad \text{(expression 5)}$$

In the above expression, c represents a sound velocity.

Then, the β-direction power calculator 110 receives the output (noise component matrix Rn) of the β-direction noise component matrix calculation section 122 and the above direction control vector $S_2$ to calculate a power in the β direction, P(β).

$$P(\beta)=1/(d[m]^H\cdot Rn[m,m]\cdot d[m]) \quad \text{(expression 6)}$$

In the expression (6), by changing the β direction from −90° to +90° and calculating P(β) for each β, direction-specific powers are calculated. Further, the βmax which provides the largest P(β) is determined. By the above process, the estimated direction of a sound source using a certain frequency in a certain time window is calculated.

Then, the above process is repeated for each frequency, and the outputs of the β-direction power calculator 110 are averaged in the frequency averaging device 113, whereby the estimated direction of the sound source in the above time window is calculated.

Then, the above process is repeated for each time window, and the outputs of the frequency averaging device 113 are averaged in the time averaging device 114, whereby the estimated β direction $S_3$ of the sound source is calculated. The estimated β direction calculation step (s1003) proceeds as described above, and the estimated β direction $S_3$ thus estimated of the sound source is inputted to the vehicle detection section 124 as the output of the β-direction calculation section 123.

In the vehicle detection step (s1004), firstly, the above estimated β direction $S_3$ of the sound source is stored in the estimated direction buffer 116 of the vehicle detection section 124 for a certain period of time. The required buffer storage time depends on the velocity of the target vehicle. The lower the velocity becomes, the more storage time is required. For example, when a vehicle traveling at a velocity of about 60 km/hr is a target, at least one second of buffering is required, and when the velocity is reduced to a half, the buffering time must be doubled.

Then, in the distance calculator 117, the distance D between the above estimated β direction $S_3$ of the sound source which has been stored in the estimated direction buffer 116 for a certain period of time and the preset sound source location template $S_4$ is calculated. The content of the estimated direction buffer 116 is expressed as f[i] (i=1 to W, W represents the size of the template). Further, when the content of the sound source location template $S_4$ is expressed as t[i] (i=1 to W, W represents the size of the template), the distance D normalized by the size of the template can be expressed as shown by (expression 7).

$$D = \sum_{i=1}^{W} |f[i] - t[i]| / W \quad \text{(expression 7)}$$

The distance D is closer to 0 when the degree of similarity between the above estimated β direction $S_3$ of the sound source which has been stored in the estimated direction buffer 116 and the sound source location template $S_4$ is higher. To prepare the sound source location template $S_4$, a method in which the sound source location template $S_4$ is prepared by sampling the data on the estimated direction of a sound source which are calculated by causing a vehicle to travel at different velocities under ideal conditions having no other vehicles and noise sources around the sound source is desirable. However, when such a method cannot be used, a method in which the sound source location template $S_4$ is prepared according to change in the direction of the sound source which is estimated from the location of the microphone array 102.

Then, in the comparator 119, the above distance D is compared with the distance reference value $S_5$. When the above distance D is shorter, it is determined that a vehicle is detected, and the above distance D is outputted as the vehicle detection result $S_6$. This vehicle detection result $S_6$ is displayed on the CRT 9 or printed on the printer 10.

An optimum distance reference value $S_5$ varies according to the location of the microphone array 102. It is desirably 20° to 50° where an ambient noise level is relatively low.

As described above, the vehicle detection apparatus of the first embodiment according to the present invention has the microphone array 102 comprising M number of microphones aligned parallel to the vehicle traveling direction in the sound collector 3 and has the noise component matrix calculation section 122 which is connected to the microphone array 102 in the substantial part of the detection apparatus which comprises the CPU 4, the memory 5 and the arithmetic circuit 11. In the noise component matrix calculation section 122, the outputs of the M number of microphones are amplified in the amplifiers 103, the outputs of the amplifiers 103 are sampled periodically with a certain time window in the waveform samplers 104, frequency analyses are conducted in the frequency analyzers 105 to calculate complex amplitude matrices for the above frequencies, correlation matrices are calculated from the above complex amplitude matrices in the correlation matrix calculator 107, the eigenvectors of the above correlation matrices are calculated in the eigenvector calculator 108, and noise component matrices corresponding to the noise components are calculated in the noise component matrix calculator 109.

Further, the above substantial part of the detection apparatus also has the β-direction calculation section 123 which is connected to the noise component matrix calculation section 122. In the βdirection calculation section 123, the direction corresponding to the apparent β direction from the microphone array 102 is set in the β-direction setting device 111, a direction control vector is calculated in the direction control vector calculator 112, β-direction powers are calculated from the above direction control vector and the above noise component matrices, the average of the above β-direction powers with respect to the frequencies and the time windows is calculated in the frequency averaging device 113 and the time averaging device 114, and the average can be outputted as the estimated β direction.

Further, the above substantial part of the detection apparatus also has the vehicle detection section 124 which is connected to the β-direction calculation section 123. In the vehicle detection section 124, after the above estimated β direction is stored in the estimated direction buffer 116 for a certain period of time, the distance between the above estimated β direction and the sound source location template which indicates a change in the location of a sound source with time while the vehicle is traveling is calculated successively, and the calculated distance is compared with the preset distance reference value in the comparator 119. When the above distance is shorter than the distance reference value, it is determined that a vehicle is detected, and the above distance is outputted as the result of vehicle detection.

Thus, by having the microphone array 102 comprising M number of microphones aligned parallel to the vehicle traveling direction in the above sound collector 3 and having the noise component matrix calculation section 122, the β-direction calculation section 123 and the vehicle detection section 124 in the substantial part of the detection apparatus which comprises the CPU 4, the memory 5 and the arithmetic circuit 11, when a plurality of vehicles are traveling simultaneously or when there are noises produced from something other than a desired vehicle, the sound source (vehicle) can be detected by suppressing the interference by other vehicles or noises.

[Second Embodiment]

Figure 5:
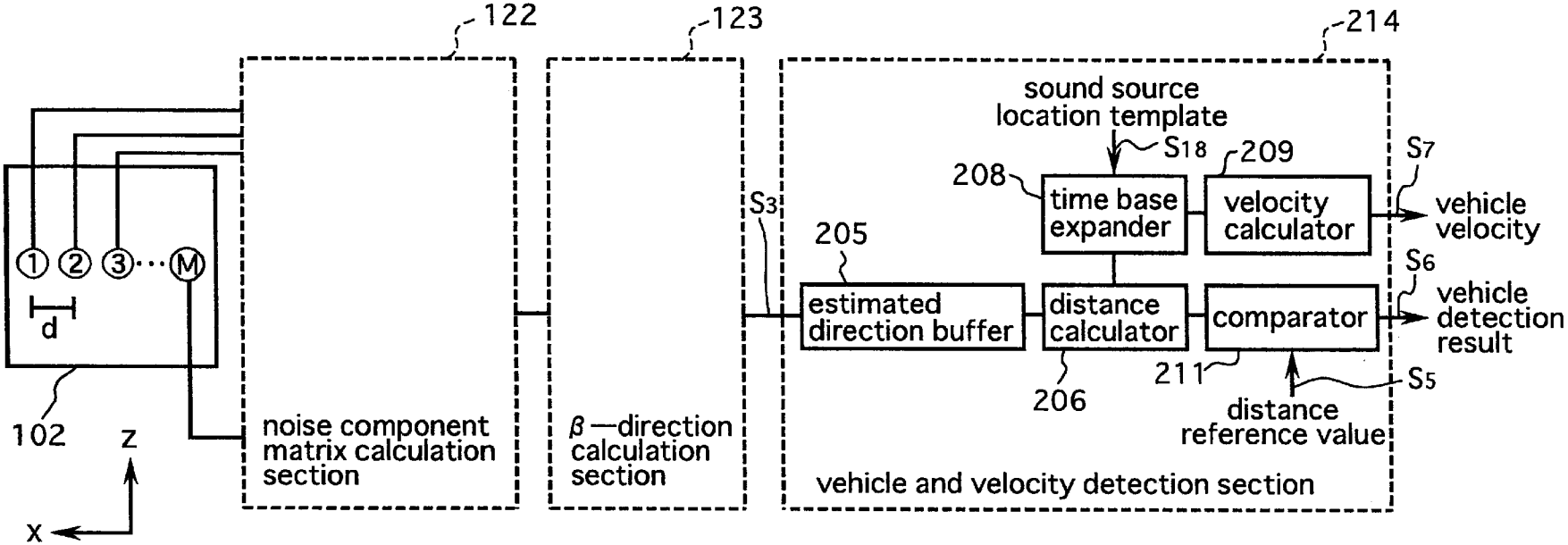
FIG. 5 is a block diagram showing the substantial part of the vehicle detection apparatus of the second embodiment according to the present invention.

FIG. 5 shows the substantial part of the vehicle detection apparatus of the second embodiment according to the present invention. Since the configuration of the whole vehicle detection apparatus and the configuration and placement of the microphone array are generally the same as those of the first embodiment, FIGS. 1 and 3 are used, and the same constituents as those in the first embodiment are referred to by the same numerals and symbols and will not be described.

The present embodiment is different from the first embodiment in that a vehicle and velocity detection section 214 is provided in place of the vehicle detection section (124 in FIG. 2) and that a time-base expander 208 and a velocity calculator 209 are provided in the vehicle and velocity detection section 214. According to this configuration, there can be obtained the effect of detecting the velocity of a vehicle by suppressing the interference by other vehicles or noises.

The vehicle and velocity detection section 214 comprises an estimated direction buffer 205 which is connected to the β-direction calculation section 123, a distance calculator 206 which is connected to the estimated direction buffer 205 and to the time-base expander 208, a comparator 211 which is connected to the distance calculator 206 and receives a preset distance reference value $S_5$, the time-base expander 208 which is connected to the above distance calculator 206 and to the velocity calculator 209 and receives a preset sound source location template $S_{18}$, and the velocity calculator 209 which is connected to the time-base expander 208. The output $S_6$ of the above comparator 211 is the result of vehicle detection, the output $S_7$ of the velocity calculator 209 is the velocity of a vehicle, and these are the outputs of the vehicle and velocity detection section 214.

Next, a vehicle detection method based on the above vehicle detection apparatus 100 will be described.

Figure 6:
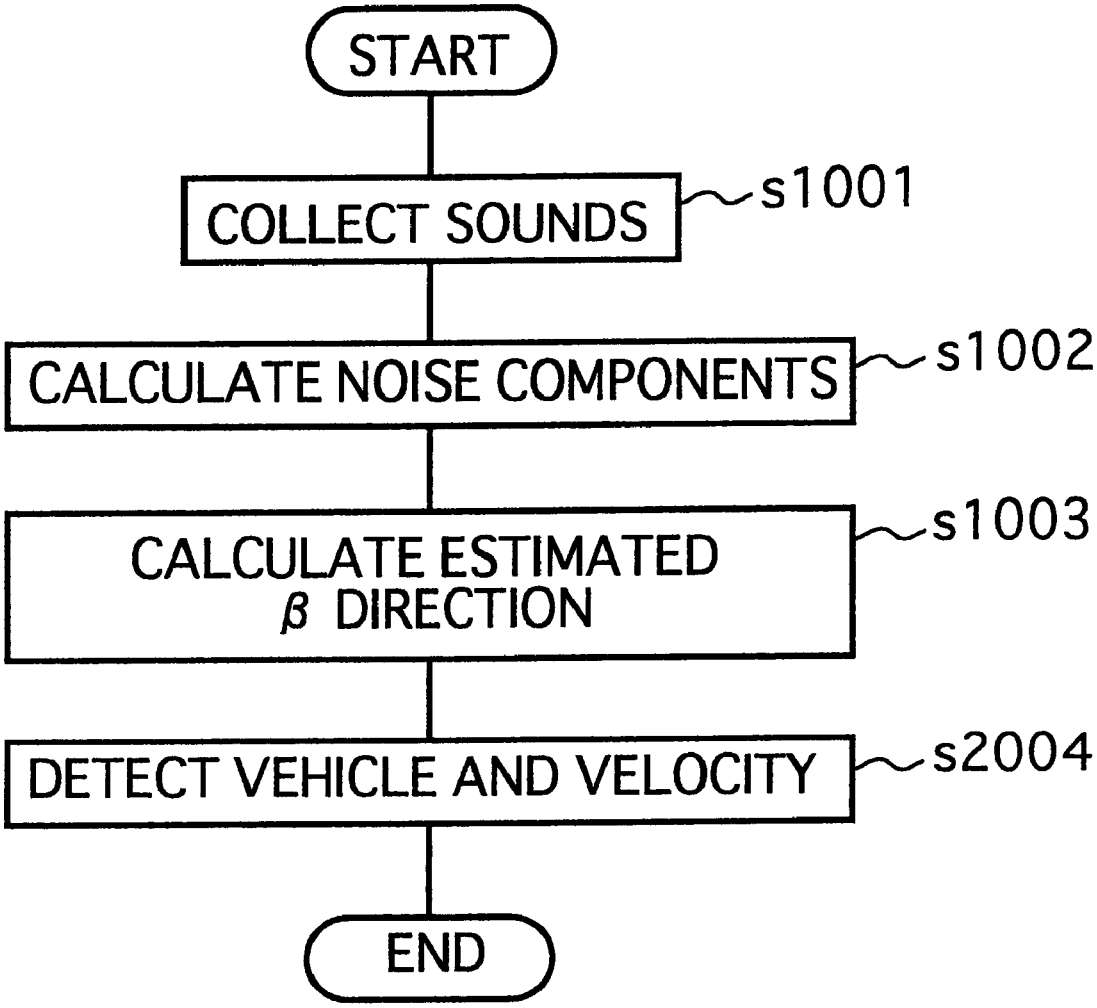
FIG. 6 is a flow chart showing the vehicle detection method of the second embodiment according to the present invention.

FIG. 6 shows the vehicle detection method of the second embodiment according to the present invention. This is different from that of the first embodiment in that a vehicle and velocity detection step (s2004) is provided in place of the vehicle detection step (s1004 in FIG. 4) and that the result of vehicle detection and the velocity of a vehicle are outputted.

A sound collection step (s1001), a noise component calculation step (s1002) and an estimated β direction calculation step (s1003) are the same as those in the first embodiment.

In the vehicle and velocity detection step (s2004), the estimated β direction $S_3$ of a sound source which has been estimated in accordance with the first embodiment is inputted to the vehicle and velocity detection section 214 as the output of the β-direction calculation section 123 and, firstly, stored in the estimated direction buffer 205 for a certain period of time. The required buffer storage time depends on the velocity of the target vehicle. The required buffer storage time depends on the velocity of the target vehicle. The lower the velocity becomes, the more storage time is required. For example, when a vehicle traveling at a velocity of about 60 km/hr is a target, at least one second of buffering is required, and when the velocity is reduced to a half, the buffering time must be doubled.

Meanwhile, the preset sound source location template $S_{18}$ is inputted to the time-base expander 208. To prepare the sound source location template $S_{18}$, a method in which the sound source location template $S_{18}$ is prepared by sampling the data on the estimated direction of a sound source which are calculated by causing the vehicle to travel at a constant velocity $V_0$ under ideal conditions having no other vehicles and noise sources around the sound source is desirable. However, when such a method cannot be used, a method in which the sound source location template $S_4$ is prepared according to change in the direction of the sound source which is estimated from the location of the microphone array 102.

In the time-base expander 208, the time base of the above sound source location template $S_{18}$ is expanded or contracted, and the expanded or contracted template is outputted. The expansion ratio p of the time base is determined by the velocity to be detected of a vehicle. For example, when the velocity which is n times as high as the vehicle velocity $V_0$ used to prepare the above sound source location template $S_{18}$ is to be detected, the expansion ratio p is set to be 1/n. When the expansion ratio p is less than 1, the sound source location template $S_{18}$ is contracted, while when the expansion ratio p is more than 1, the sound source location template $S_{18}$ is expanded. Further, when the time base of the sound source location template $S_{18}$ is provided in a discrete manner, the sound source location template $S_{18}$ is approximated continuously, and the expanded or contracted template is then calculated. The template after expansion or contraction is inputted to the distance calculator 206.

Then, the distance calculator 206 receives the estimated β direction $S_3$ of the sound source which has been stored in the estimated direction buffer 205 and the above expanded or contracted template and calculates the distance D between the template and the sound source.

The size Ws of the expanded or contracted template is W×p. When the expanded or contracted template is expressed as ts[i] (i=1 to Ws) and the content (estimated β direction $S_3$ of the sound source) of the estimated direction buffer 205 as f[i] (i=1 to W, W represents the size of the template), the distance D normalized by the size of the template can be expressed by (expression 8).

$$D = \sum_{i=1}^{W} |f[i] - ts[i]| Ws \qquad \text{(expression 8)}$$

The distance D is calculated by changing the expansion ratio p within the range of the estimated velocity of a vehicle. The distance D is closer to 0 when the degree of similarity between the estimated direction buffer 205 and the expanded or contracted template ts[i] is higher.

Then, the comparator 211 compares the input (the above distance D) from the distance calculator 206 with the preset distance reference value $S_5$ inputted in advance. When the above distance D is shorter, it is determined that a vehicle is detected, and the above distance D is outputted as the vehicle detection result $S_6$. An optimum distance reference value $S_5$ varies according to the location of the microphone array 102. It is desirably 20° to 50° where an ambient noise level is relatively low.

Meanwhile, the velocity calculator 209 calculates the velocity of the vehicle from the inputs (the above expansion ratios of the time base) from the time-base expander 208. When the velocity of the vehicle is $V_0$ and the expansion ratio which provides the shortest distance D is pm, "pm×$V_0$" is calculated as the vehicle velocity $S_7$. This vehicle velocity $S_7$, together with the aforementioned vehicle detection result $S_6$, is displayed on the CRT 9 or printed on the printer 10.

As described above, the vehicle detection apparatus of the second embodiment according to the present invention has the vehicle and velocity detection section 214 which is connected to the β-direction calculation section 123 in the above substantial part of the detection apparatus. In this vehicle and velocity detection section 214, using the expansion ratio when the time base of the sound source location template $S_{18}$ is expanded or contracted in the time-base expander 208, the velocity $S_7$ of the detected vehicle is calculated by the velocity calculator 209.

[Third Embodiment]

Figure 7:
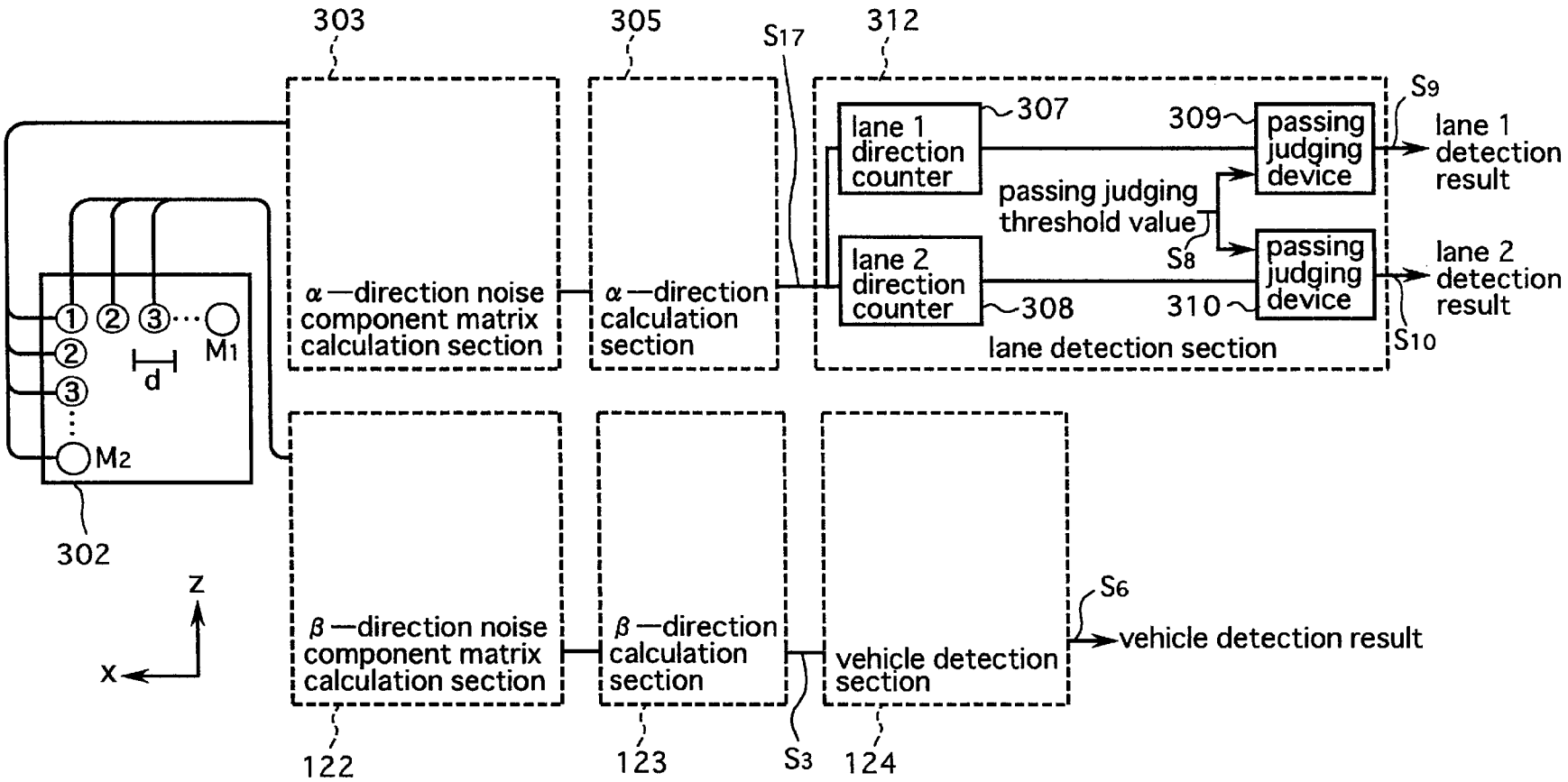
FIG. 7 is a block diagram showing the substantial part of the vehicle detection apparatus of the third embodiment according to the present invention.
Figure 8:
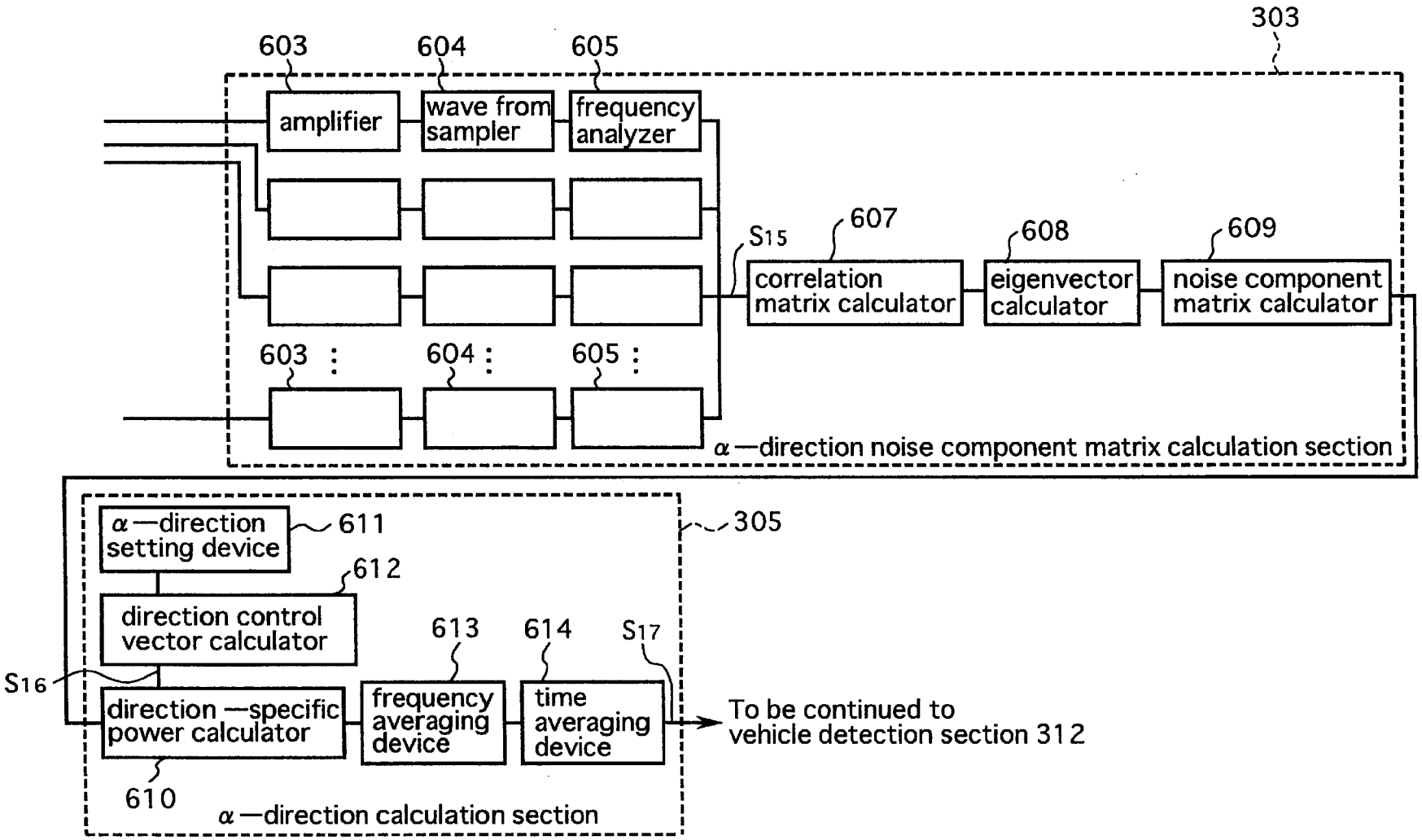
FIG. 8 is a block diagram showing the substantial part (α-direction noise component calculation section and α-direction calculation section) of the vehicle detection apparatus of the third embodiment according to the present invention.

FIGS. 7 and 8 show the substantial part of the vehicle detection apparatus of the third embodiment according to the present invention. Since the configuration of the whole vehicle detection apparatus is generally the same as that of the first embodiment, FIG. 1 is used, and the same constituents as those in the first embodiment are referred to by the same numerals and symbols and will not be described.

The present embodiment is different from the first embodiment in that a microphone array 302 comprising $M_1$ number of microphones aligned in the x-axis direction and $M_2$ number of microphones aligned in the y-axis direction is used in place of the microphone array (102 in FIG. 1) comprising M number of microphones aligned in the x-axis direction. Further, the present embodiment is also different from the first embodiment in that an α-direction noise component matrix calculation section 303 is further provided and that amplifiers 603, waveform samplers 604, frequency analyzers 605, a correlation matrix calculator 607, an eigenvector calculator 608 and a noise component matrix calculator 609 are provided in the α-direction noise component matrix calculation section 303. Still further, the present embodiment is also different from the first embodiment in that an α-direction calculation section 305 is further provided and that an α-direction setting device 611, a direction-specific power calculator 610, a direction control vector calculator 612, a frequency averaging device 613 and a time averaging device 614 are provided in the α-direction calculation section 305. Still further, the present embodiment is also different from the first embodiment in that a lane detection section 312 is further provided and that a lane 1 direction counter 307, a lane 2 direction counter 308 and passing judging devices 309 and 310 are provided in the lane detection section 312. According to this configuration, there can be obtained the effect of detecting the location in the lane direction of a detected vehicle by suppressing the interference by other vehicles or noises on the road having a plurality of lanes.

Figure 9:
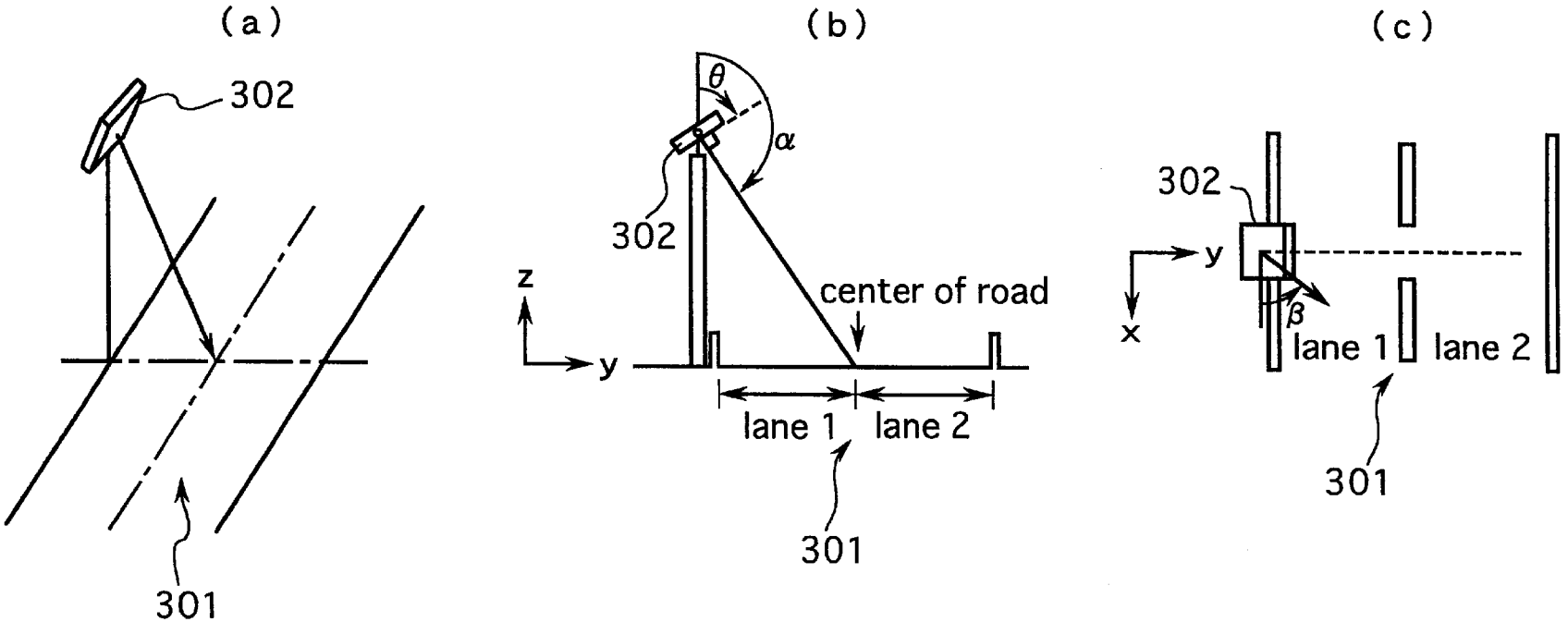
FIG. 9 is a diagram showing the placement of the microphone array of the third embodiment according to the present invention.

As shown in FIG. 9(*a*), the microphone array 302 is placed such that it looks down at the road. Further, as shown in FIG. 7, it comprises $M_1$ number of microphones aligned on a line parallel to the vehicle traveling direction of a road 301 having a plurality of lanes (lane 1 and lane 2 shown in FIG. 9) and $M_2$ number of microphones aligned on a line perpendicular to the vehicle traveling direction. The microphones constituting the microphone array 302 are the same as those constituting the microphone array 102 in the first embodiment. Further, the above numbers $M_1$ and $M_2$ of microphones are the same as the number M of microphones in the first embodiment and, in the present embodiment (multi-lane road), $M_1$ and $M_2$ are set to be "number of lanes+1" to "number of lanes×2", respectively. In addition, the interval between the microphones is also set to be a regular interval d in accordance with the first embodiment, and the value of d is set to be 5 to 34 cm, preferably 5 to 10 cm.

Further, as shown in FIG. 9(*b*), the microphone array 302 is configured such that it can be rotated in a vertical direction. An α represents the angle formed by the normal extended from the plane on which the microphone array 302 is placed and the z axis. FIG. 9(*b*) shows the case where the above normal crosses the center of the multi-lane road. Further, as shown in FIG. 9(*c*), the microphone array 302 is configured such that it can also be rotated in a horizontal direction and that the direction of noises (vehicle) is estimated by an angle β formed by the normal extended from the plane on which the microphone array 102 is placed and the x axis.

In the microphone array 302, the outputs of the $M_1$ number of microphones aligned on the line parallel to the vehicle traveling direction are inputted to the β-direction noise component matrix calculation section (noise component matrix calculation section) 122, and the outputs of the $M_2$ number of microphones aligned on the line perpendicular to the vehicle traveling direction are inputted to the α-direction noise component matrix calculation section 303.

The α-direction noise component matrix calculation section 303 comprises $M_2$ number of amplifiers 603 which are connected to the $M_2$ number of microphones of the microphone array 302, $M_2$ number of waveform samplers 604 which are connected to the $M_2$ number of amplifiers 603, $M_2$ number of frequency analyzers 605 which are connected to the $M_2$ number of waveform samplers 604, a correlation matrix calculator 607 which is connected to the $M_2$ number of frequency analyzers 605, an eigenvector calculator 608 which is connected to the correlation matrix calculator 607, and a noise component matrix calculator 609 which is connected to the eigenvector calculator 608.

Further, the α-direction calculation section 305 comprises an α-direction setting device 611 which sets the vertical scanning direction (α direction) of the microphone array 302, a direction control vector calculator 612 which is connected to the α-direction setting device 611, a direction-specific power calculator 610 which is connected to the direction control vector calculator 612 and receives the output of the α-direction noise component matrix calculation section 303, a frequency averaging device 613 which is connected to the direction-specific power calculator 610, and a time averaging device 614 which is connected to the frequency averaging device 613. The output (estimated α direction) $S_{17}$ of the α-direction calculation section 305 is outputted, via the frequency averaging device 613 and the time averaging device 614, from the above direction-specific power calculator 610.

The β-direction noise component matrix calculation section (noise component matrix calculation section) 122 and the β-direction calculation section 123 are the same as their counterparts in the first embodiment except that the number of microphones in the microphone array is changed from M to $M_1$. Further, the α-direction noise component matrix calculation section 303 and the α-direction calculation section 305 are the same as their counterparts in the first embodiment except that the number of microphones in the microphone array is changed from M to $M_2$ and that a variable α is substituted for the variable β.

The lane detection section 312 comprises a lane 1 direction counter 307 and a lane 2 direction counter 308 which are connected to the α-direction calculation section 305, and passing judging devices 309 and 310 which are connected to the lane 1 direction counter 307 and the lane 2 direction counter 308, respectively, and receive a preset passing judging threshold value $S_8$. The outputs $S_9$ and $S_{10}$ of the passing judging devices 309 and 310 are the outputs (lane 1 detection result and lane 2 detection result) of the lane detection section 312.

Next, a vehicle detection method based on the above vehicle detection apparatus 100 will be described.

Figure 10:
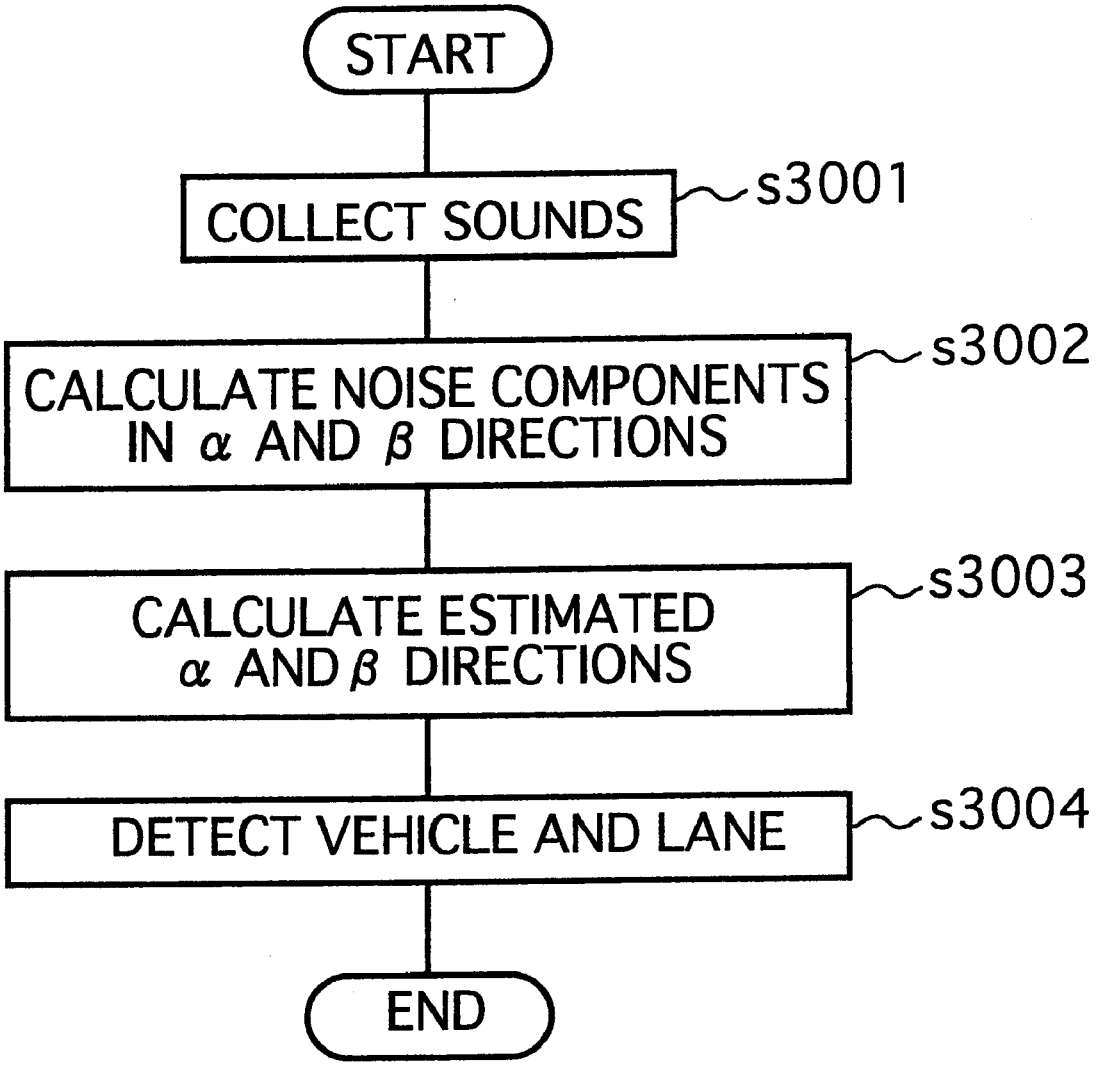
FIG. 10 is a flow chart showing the vehicle detection method of the third embodiment according to the present invention.

FIG. 10 shows the vehicle detection method of the third embodiment according to the present invention. This method is different from that of the first embodiment in that it comprises a sound collection step (s3001), an αβ-direction noise component calculation step (s3002), an estimated αβ-direction calculation step (s3003) and a vehicle and lane detection step (s3004). According to this method, there can be obtained the effect of detecting the location in the vehicle traveling direction and the lane direction of a vehicle.

In the sound collection step (s3001), the microphone array 302 is controlled by the above input control section 1 to collect the noises produced by the vehicles and the like on the multi-lane road 301 having a lane 1 and a lane 2. In this microphone array 302, the outputs of the $M_1$ number of microphones aligned on the line parallel to the vehicle traveling direction are inputted to and amplified by the amplifiers 103 in the β-direction noise component matrix calculation section 122, and the outputs of the $M_2$ number of microphones aligned on the line perpendicular to the vehicle traveling direction are inputted to and amplified by the amplifiers 603 in the α-direction noise component matrix calculation section 303.

In the αβ-direction noise component calculation step (s3002), after the outputs of the $M_1$ number of microphones of the above microphone array 302 are amplified by the amplifiers 103 and the outputs of the $M_2$ number of microphones of the microphone array 302 are amplified by the amplifiers 603, these amplified outputs are inputted to the waveform samplers 104 and 604, respectively, and sampled periodically with a time window having a window length W. The shape of the time window, the window length W and the period of sampling by the time window are set in accordance with the first embodiment.

For the time signals thus-sampled in the waveform samplers 104 and 604, complex amplitudes $S_1$ and $S_{15}$ for each frequency are calculated in the frequency analyzers 105 and 605. A method for calculating the complex amplitudes is selected in accordance with the first embodiment.

Then, in the correlation matrix calculators 107 and 607, correlation matrices are calculated from the output (complex amplitude matrix) $S_1$ of the $M_1$ number of the frequency analyzers 105 and the output (complex amplitude matrix) $S_{15}$ of the $M_2$ number of the frequency analyzers 605 by the above (expression 2) and expressed in the form of a matrix R[m,m].

Then, in the eigenvector calculators 108 and 608, the eigenvectors $v_1[m]$, $v_2[m]$, $v_M[m]$ (m=1 to $M_1$ and 1 to $M_2$) of each matrix R[m,m] are calculated. A method for calculating the above eigenvectors is selected in accordance with the first embodiment.

Then, in the noise component matrix calculators 109 and 609, the matrices Rn[m,m] corresponding to the noise components in the α and β directions when there are K number of sound sources are calculated by the above (expression 3). When the number K of sound sources cannot be estimated in advance, it is set to be "K=M−1" in accordance with the first embodiment. The thus-calculated α-direction noise component matrix and β-direction noise component matrix are outputted from the α-direction noise component matrix calculation section 303 and the β-direction noise component matrix calculation section 122 and inputted to the α-direction calculation section 305 and the β-direction calculation section 123, respectively.

In the estimated αβ-direction calculation step (s3003), firstly, an α is set in the α-direction setting device 611 in the α-direction calculation section 305. Then, the above α is inputted to the direction control vector calculator 612, and a direction control vector $S_{16}$ is calculated by using the above (expression 4) and (expression 5). Meanwhile, a β is set in the β-direction setting device 111 in the β-direction calculation section 123 in accordance with the first embodiment. Then, the above β is inputted to the direction control vector calculator 112, and a direction control vector $S_2$ is calculated by using the above (expression 4) and (expression 5).

Then, the direction-specific power calculator 610 receives the output (noise component matrix Rn) of the α-direction noise component matrix calculation section 303 and the above direction control vector $S_{16}$ to calculate a power in the α direction, P(α), by the above (expression 6). By changing the α direction from −90° to +90°, P(α) is calculated for each α, and the αmax which provides the largest P(α) is determined. By the above process, the estimated α direction of a sound source using a certain frequency in a certain time window is calculated (α-direction calculation process). Meanwhile, the direction-specific power calculator 110 receives the output (noise component matrix Rn) of the β-direction noise component matrix calculation section 122 and the above direction control vector $S_2$ to calculate a power in the β direction, P(β), and determine the βmax which provides the largest P(β) by the above (expression 6) in accordance with the first embodiment, whereby the estimated β direction of the sound source using a certain frequency in a certain time window is calculated (β-direction calculation process).

Then, the above α-direction calculation process is repeated for each frequency, and the outputs of the α-direction power calculator 610 are averaged in the frequency averaging device 613, whereby the estimated α direction of the sound source in the above time window is calculated. Meanwhile, the above β-direction calculation process is repeated for each frequency, and the outputs of the β-direction power calculator 110 are averaged in the frequency averaging device 113, whereby the estimated β direction of the sound source in the above time window is calculated.

Then, the above α-direction calculation process is repeated for each time window, and the outputs of the frequency averaging device 113 are averaged in the time averaging device 614, whereby the estimated α direction $S_{17}$ of the sound source is calculated. Meanwhile, the above β-direction calculation process is repeated for each time window, and the outputs of the frequency averaging device 113 are averaged in the time averaging device 114, wherein the estimated β direction $S_3$ of the sound source is calculated.

The estimated αβ-direction calculation step (s3003) proceeds as described above. The estimated α direction $S_{17}$ thus estimated of the sound source is inputted to the lane detection section 312 as the output of the α-direction calculation section 305, and the estimated β direction $S_3$ of the sound source is inputted to the vehicle detection section 124 as the output of the β-direction calculation section 123.

In the vehicle and lane detection step (s3004), the output α (estimated α direction $S_{17}$ of the sound source) of the α-direction calculation section 305 is inputted to the lane 1 direction counter 307 in the lane detection section 312 and stored in a buffer for a certain period of time. Of the stored outputs α, the number of those between the preset lower limit ($\alpha_1$L) and upper limit ($\alpha_1$H) of the lane 1 direction is outputted.

Meanwhile, the output α (estimated α direction $S_{17}$ of the sound source) of the α-direction calculation section 305 is inputted to the lane 2 direction counter 308 and stored in a buffer for a certain period of time. Of the stored outputs α, the number of those between the preset lower limit ($\alpha_2$L) and upper limit ($\alpha_2$H) of the lane 2 direction is outputted.

The buffer storage time required by the lane 1 direction counter 307 and the lane 2 direction counter 308 depends on the velocity of the target vehicle. The lower the velocity becomes, the more storage time is required. For example, when a vehicle traveling at a velocity of about 60 km/hr is a target, at least one second of buffering is required, and when the velocity is reduced to a half, the buffering time must be doubled.

Then, the passing judging device 309 receives the output of the lane 1 direction counter 307 and the preset passing judging threshold value $S_8$ and outputs the output of the lane 1 direction counter 307 as the lane 1 detection result $S_9$ when the output of the lane 1 direction counter 307 is larger than or equal to the passing judging threshold value $S_8$. The value set as the passing judging threshold value $S_8$ is suitably about ⅕ to ½ of the number of detections in all directions in a buffer length of the lane 1 direction.

Further, the lane 2 passing judging device 310 receives the output of the lane 2 direction counter 308 and the preset passing judging threshold value $S_8$ and outputs the output of the lane 2 direction counter 308 as the lane 2 detection result $S_{10}$ when the output of the lane 2 direction counter 308 is larger than or equal to the passing judging threshold value $S_8$.

Meanwhile, in accordance with the first embodiment, the output (estimated β direction $S_3$ of the sound source) of the β-direction calculation section 123 is inputted to the vehicle detection section 124 and stored in the estimated direction buffer 116 for a certain period of time. Then, the distance calculator 117 receives the above estimated β direction $S_3$ of the sound source and the preset sound source location template $S_4$ and calculates a distance D. Thereafter, the comparator 119 compares the above distance D with the distance reference value $S_5$ and outputs the distance D as the vehicle detection result $S_6$ when the above distance D is shorter.

As described above, the vehicle detection apparatus of the third embodiment according to the present invention has the microphone array 302 comprising $M_1$ number of microphones aligned parallel to the vehicle traveling direction and $M_2$ number of microphones aligned perpendicular to the vehicle traveling direction in the sound collector 3 and has the α-direction noise component matrix calculation section 303 which is connected to the above $M_2$ number of microphones of the microphone array 302 in the substantial part of the detection apparatus which comprises the CPU 4, the memory 5 and the arithmetic circuit 11. In the α-direction noise component matrix calculation section 303, the outputs of the $M_2$ number of microphones aligned perpendicular to the vehicle traveling direction are amplified in the amplifiers 603, the outputs of the amplifiers 603 are sampled periodically with a certain time window in the waveform samplers 604, frequency analyses are conducted in the frequency analyzers 605 to calculate complex amplitude matrices for the above frequencies, correlation matrices are calculated from the above complex amplitude matrices in the correlation matrix calculator 607, the eigenvectors of the above correlation matrices are calculated in the eigenvector calculator 608, and noise component matrices corresponding to the noise components in the outputs of the $M_2$ number of microphones are calculated in the noise component matrix calculator 609.

Further, the above substantial part of the detection apparatus also has the α-direction calculation section 305 which is connected to the α-direction noise component matrix calculation section 303. In the α-direction calculation section 305, the direction corresponding to the apparent α direction from the microphone array 302 is set in the α-direction setting device 611, a direction control vector is calculated in the directional vector calculator 612, α-direction powers are calculated from the above direction control vector and the above noise component matrices, the average of the β-direction powers with respect to the frequencies and the time windows is calculated in the frequency averaging device 613 and the time averaging device 614, and the average can be outputted as the estimated α direction.

Further, the above substantial part of the detection apparatus also has the lane detection section 312 which is connected to the α-direction calculation section 305. In the lane detection section 312, the output $S_{17}$ of the α-direction calculation section 305 is inputted to the lane 1 direction counter 307 and the lane 2 direction counter 308 and stored therein for a certain period of time. Of the stored outputs α, the numbers of those between the preset upper limits and lower limits in the α direction of the lane 1 direction and the lane 2 direction can be outputted as the lane 1 detection result and the lane 2 detection result, respectively.

In addition, since the above substantial part of the detection apparatus has the β-direction noise component matrix calculation section 122, the β-direction calculation section 123 and the vehicle detection section 124 in accordance with the first embodiment, the location in the vehicle traveling direction of a vehicle can be detected by the outputs of the $M_1$ number of microphones.

Thus, by referring to the above lane 1 detection result $S_9$ and the lane 2 detection result $S_{10}$ when a traveling vehicle is detected by the vehicle detection section 124 and the vehicle detection result $S_6$ is outputted, it can be determined in which lane the detected vehicle is traveling. That is, even when a plurality of vehicles are traveling simultaneously or when there are noises produced from something other than a desired vehicle, the location in the vehicle traveling direction and the lane direction of the vehicle can be detected by suppressing the interference by other vehicles or noises.

[Fourth Embodiment]

Figure 11:
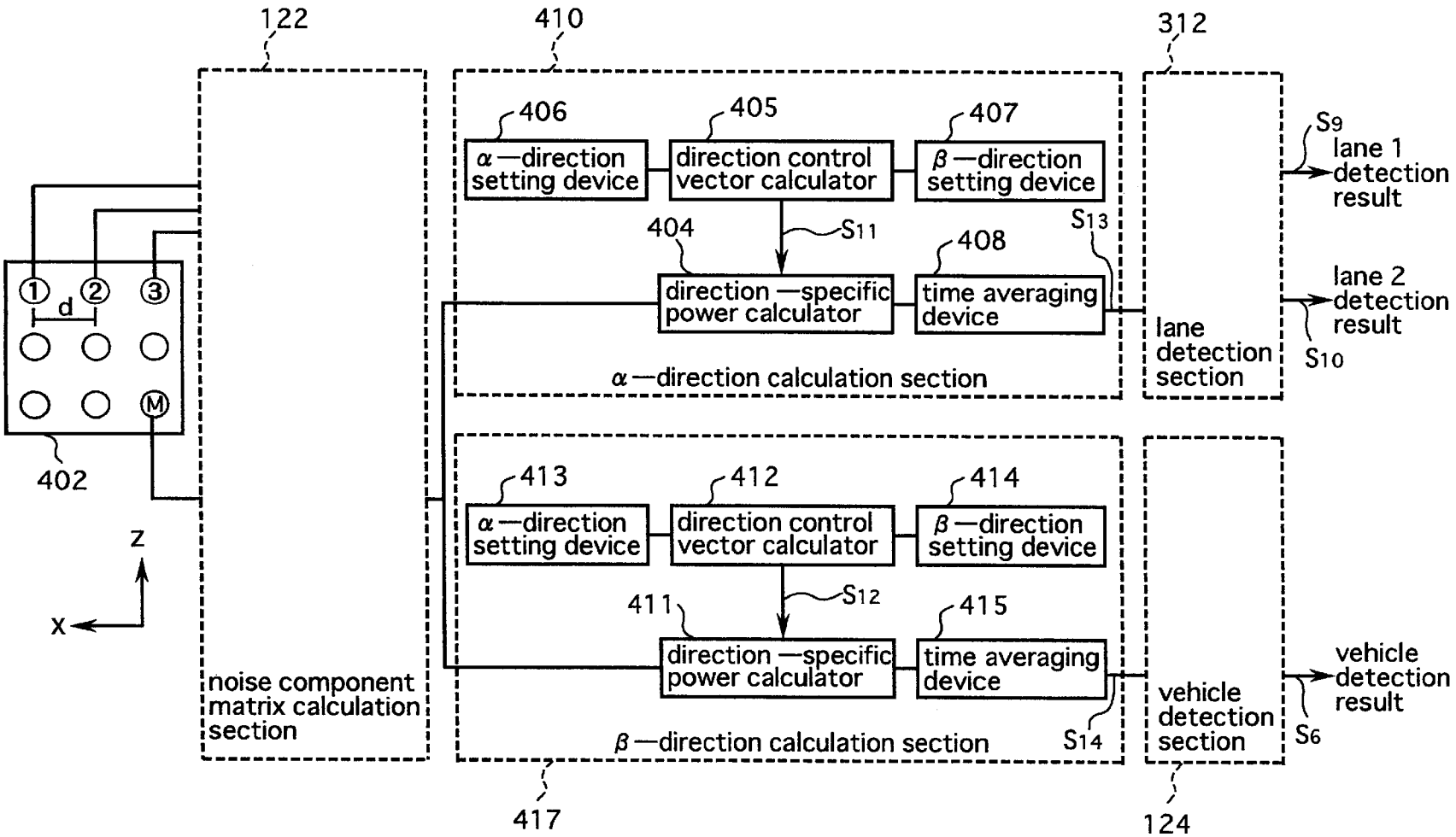
FIG. 11 is a block diagram showing the substantial part of the vehicle detection apparatus of the fourth embodiment according to the present invention.

FIG. 11 shows the substantial part of the vehicle detection apparatus of the fourth embodiment according to the present invention. Since the configuration of the whole vehicle detection apparatus is generally the same as that of the first embodiment, FIG. 1 is used, and the same constituents as those in the first embodiment are referred to by the same numerals and symbols and will not be described.

The present embodiment is different from the first embodiment in that a microphone array 402 comprising M number of microphones arranged in the form of a matrix in one plane is used in place of the microphone array (102 in FIG. 1) comprising M number of microphones aligned in the x-axis direction. Further, the present embodiment is also different from the first embodiment in that an α-direction calculation section 410 is further provided and that an α-direction setting device 406, a β-direction setting device 407, a direction control vector calculator 405, a direction-specific power calculator 404 and a time averaging device 408 are provided in the α-direction calculation section 410. Still further, the present embodiment is also different from the first embodiment in that a β-direction calculation section 417 is provided in place of the β-direction calculation section 123 and that an α-direction setting device 413, a β-direction setting device 414, a direction control vector calculator 412, a direction-specific power calculator 411 and a time averaging device 415 are provided in the β-direction calculation section 417. Still further, the present embodiment is also different from the first embodiment in that a lane detection section 312 is further provided (third embodiment) and that a lane 1 direction counter 307, a lane 2 direction counter 308 and passing judging devices 309 and 310 are provided in the lane detection section 312. According to this configuration, there can be obtained the effect of detecting the location in the lane direction of a detected vehicle by suppressing the interference by other vehicles or noises on the road having a plurality of lanes.

Figure 12:
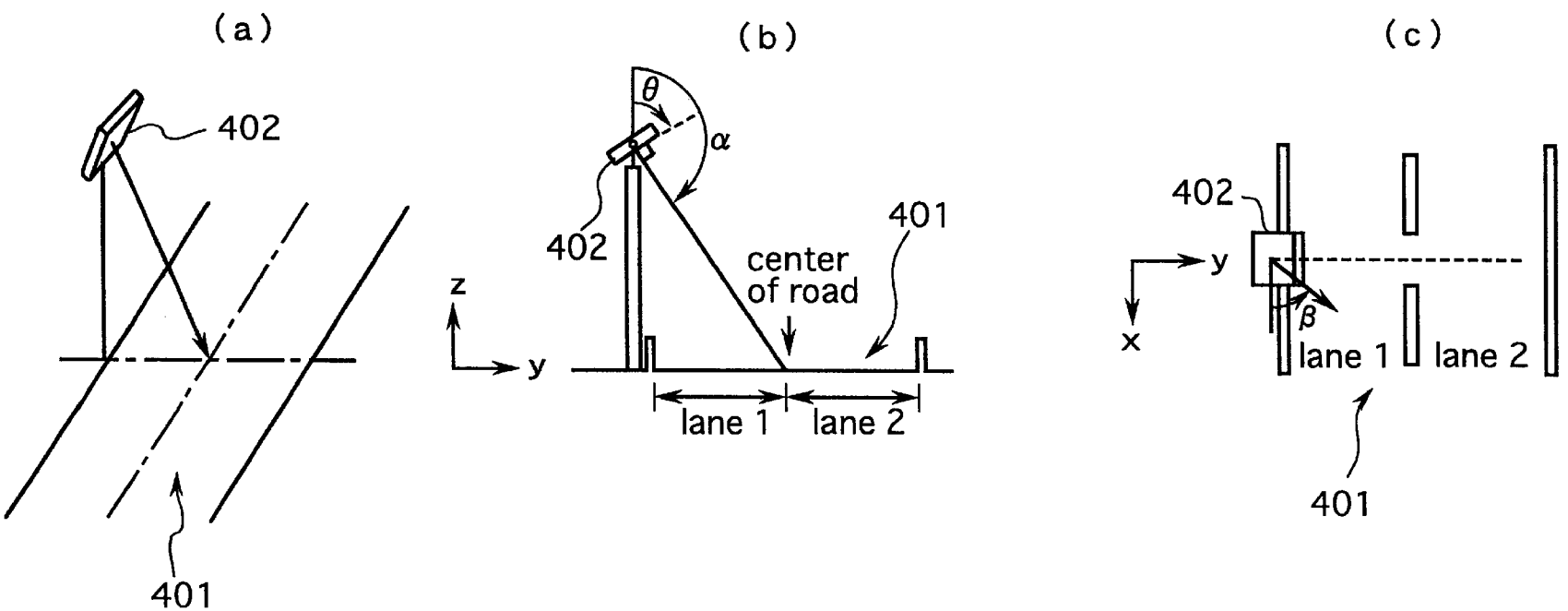
FIG. 12 is a diagram showing the placement of the microphone array of the fourth embodiment according to the present invention.

The microphone array 402 is placed such that it looks down at the road 401 having a lane 1 and a lane 2 as shown in FIG. 12(*a*) and comprises M number of microphones arranged in the form of a matrix as shown in FIG. 11. The microphones constituting the microphone array 402 are the same as those constituting the microphone array 102 in the first embodiment. As for the number of microphones, M is set to be "number of lanes+1" to "number of lanes×2" in order for the microphones to be used for the multi-lane road 401. In addition, the interval between the microphones is also set to be a regular interval d in accordance with the first embodiment, and the value of d is set to be 5 to 34 cm, preferably 5 to 10 cm.

Further, as shown in FIG. 12(*b*), the microphone array 402 is configured such that it can be rotated in a vertical direction. An α represents the angle formed by the normal extended from the plane on which the microphone array 402 is placed and the z axis. FIG. 12(*b*) shows the case where the above normal crosses the center of the multi-lane road. Further, as shown in FIG. 12(*c*), the microphone array 402 is configured such that it can also be rotated in a horizontal direction and that the direction of noises (vehicle) is estimated by the angle β formed by the normal extended from the plane on which the microphone array 402 is placed and the x axis.

Further, the α-direction calculation section 410 comprises an α-direction setting device 406 which sets the vertical scanning direction (α direction) of the microphone array 402, a β-direction setting device 407 which sets the horizontal scanning direction (β direction) of the microphone array 402, a direction control vector calculator 405 which is connected to the α-direction setting device 406 and to the β-direction setting device 407, a direction-specific power calculator 404 which is connected to the direction control vector calculator 405 and receives the output of the noise component matrix calculation section 122, and a time averaging device 408 which is connected to the direction-specific power calculator 404. The output (estimated α direction) $S_{13}$ of the α-direction calculation section 410 is outputted from the above direction-specific power calculator 404 via the time averaging device 408.

Meanwhile, the β-direction calculation section 417 comprises an α-direction setting device 413 which sets the vertical scanning direction (α direction) of the microphone array 402, a β-direction setting device 414 which sets the horizontal scanning direction (β direction) of the microphone array 402, a direction control vector calculator 412 which is connected to the α-direction setting device 413 and to the β-direction setting device 414, a direction-specific power calculator 411 which is connected to the direction control vector calculator 412 and receives the output of the noise component matrix calculation section 122, and a time averaging device 415 which is connected to the direction-specific power calculator 411. The output (estimated β direction) $S_{14}$ of the β-direction calculation section 417 is outputted from the above direction-specific power calculator 411 via the time averaging device 415.

Next, a vehicle detection method based on the above vehicle detection apparatus 100 will be described.

Figure 13:
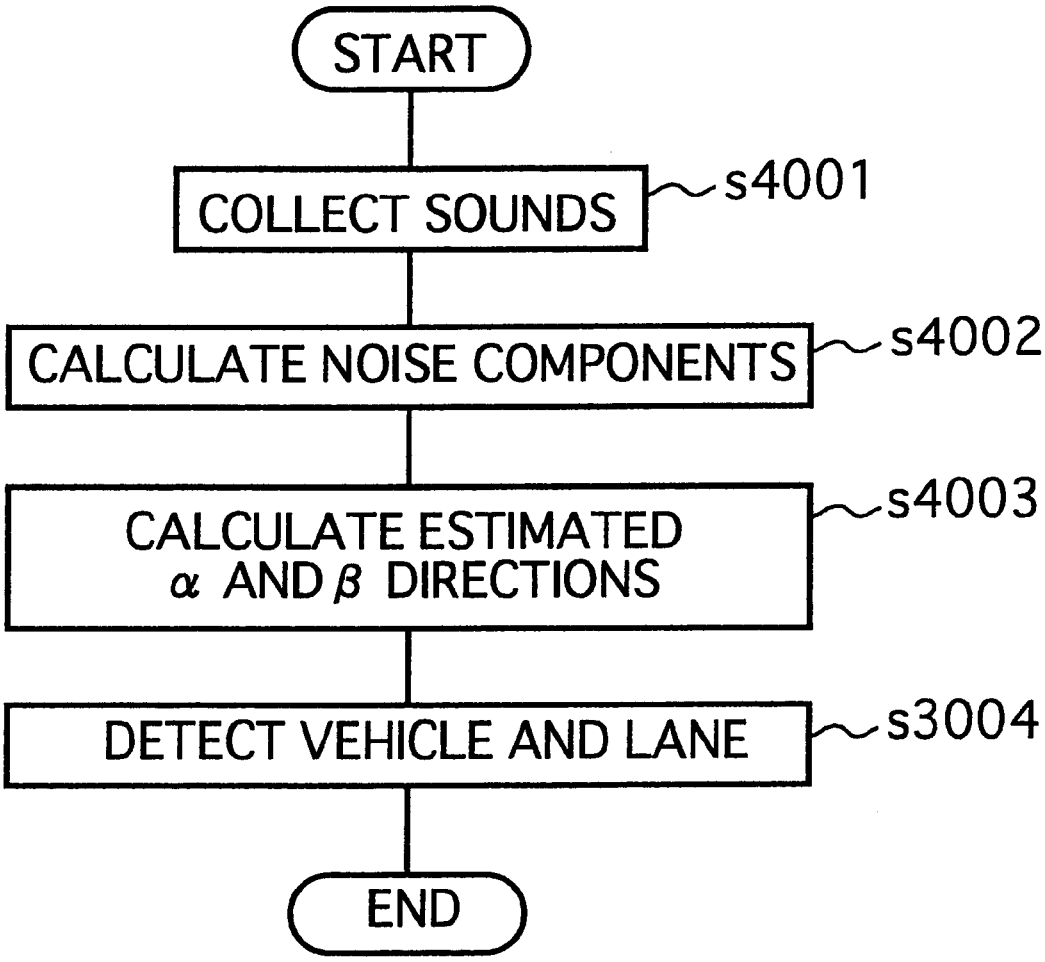
FIG. 13 is a flow chart showing the vehicle detection method of the fourth embodiment according to the present invention.

FIG. 13 shows the vehicle detection method of the fourth embodiment according to the present invention. This is different from that of the first embodiment in that a sound collection step (s4001), an estimated αβ-direction calculation step (s4003) and a vehicle and lane detection step (s3004) are provided in place of the sound collection step (s1001 in FIG. 4), the estimated β direction calculation step (s1003 in FIG. 4) and the vehicle detection step (s1004 in FIG. 4), respectively. According to this method, there can be obtained the effect of detecting the location in the lane direction of a detected vehicle.

In the sound collection step (s4001), the microphone array 402 comprising M number of microphones arranged in the form of a matrix in one plane is controlled by the above input control section 1 to collect the sounds produced by the vehicles and the like on the road 401 having the lane 1 and the lane 2, and the outputs of the above M number of microphones are inputted to and amplified by the amplifiers 103 in the noise component matrix calculation section 122.

In the noise component calculation step (s4002), in accordance with the first embodiment, after the outputs of the above microphone array 402 are amplified by the amplifiers 103, a noise component matrix Rn[m,m] is calculated and outputted from the noise component matrix calculation section 122. The output of the noise component matrix calculation section 122 is inputted to the α-direction calculation section 410 and the β-direction calculation section 417.

In the estimated αβ-direction calculation step (s4003), in the α-direction calculation section 410, the α-direction setting device 406 scans the angle α covering the vehicle traveling area in the lane direction. Meanwhile, the β-direction setting device 407 sets a β (fixed value). This fixed value β is the most suitably 90°, which corresponds to the front of the microphone array 402.

Then, the direction control vector calculator 405 receives the outputs of the α-direction setting device 406 and the β-direction setting device 407 and calculates a direction control vector d[m] by using (expression 9).

$$d[m]=[1,e^{-j\omega\tau[1]},e^{-j\omega\tau[2]},\ldots,e^{-j\omega\tau[M-1]}]^T \quad \text{(expression 9)}$$

In the above expression, τ[m] is defined by (expression 10).

$$\tau[m]=(\Delta[m])/c \quad \text{(expression 10)}$$

In the above expression, c represents a sound velocity. Further, Δ[m] represents a path difference and can be expressed as (expression 11) by using the coordinates (x[m], y[m],z[m]) and orientation (α,β) of the microphones and a distance L between the sound source and the microphones. The path difference is calculated based on the distance between the sound source and the microphones.

$$\Delta[m]=\{(x[m]-x[1]-L\cos\alpha\sin\beta)^2+(y[m]-y[1]-L\sin\alpha\sin\beta)^2+(z[m]-z[1]-L\cos\beta)^2\}^{1/2} \quad \text{(expression 11)}$$

In the above expression, a sufficiently great distance L (1,000 m or greater, for example) results in a plane wave incidence condition. As the practical value for vehicle detection, the distance L is suitably set to be the distance between the microphones and the center of the road. The thus-calculated direction control vector $S_{11}$ is inputted to the direction-specific power calculator 404 as the output of the direction control vector calculator 405.

Then, the direction-specific power calculator 404 receives the direction control vector $S_{11}$ and calculates a direction-specific power in accordance with the first embodiment. This direction-specific power is inputted to the time averaging device 408. The direction-specific power calculator 404 corresponds to the direction-specific power calculator 110 shown in FIG. 2.

The above direction-specific power calculation process is repeated for each time window. By averaging the calculated direction-specific powers in the time averaging device 408, an estimated α direction $S_{13}$ is outputted. The time averaging device 408 corresponds to the time averaging device 114 shown in FIG. 2. By scanning the α with the β fixed, the estimated a direction $S_{13}$ can be calculated.

Meanwhile, in the β-direction calculation section 417, the α-direction setting device 413 sets an α (fixed value). This fixed value is the most suitably the direction to the center of the road. The β-direction setting device 414 scans the angle β covering the vehicle traveling area in the vehicle traveling direction.

Then, the direction control vector calculator 412 receives the outputs of the α-direction setting device 413 and the β-direction setting device 414 and calculates a direction control vector d[m] by the (expression 9) to (expression 11) as described above. The thus-calculated direction control vector is inputted to the direction-specific power calculator 411 as the output $S_{12}$ of the direction control vector calculator 412.

Then, the direction-specific power calculator 411 receives the output (direction control vector) $S_{12}$ of the direction control vector calculator 412 and calculates a direction-specific power by using the direction control vector $S_{12}$. The direction-specific power calculator 411 is identical to the direction-specific power calculator 110 shown in FIG. 2.

Then, the time averaging device 415 receives the output (direction-specific power) of the direction-specific power calculator 411 and outputs an estimated β direction $S_{14}$ in accordance with the first embodiment. The time averaging device 415 is identical to the time averaging device 114 shown in FIG. 2. Thus, by scanning the β with the α fixed, the estimated β direction $S_{14}$ can be calculated.

In the vehicle and lane detection step (s3004), the lane detection section 312 receives the output $S_{13}$ of the α-direction calculation section 410 and outputs a lane 1 detection result $S_9$ and a lane 2 detection result $S_{10}$ in accordance with the third embodiment.

Meanwhile, in the vehicle detection section 124, the estimated direction buffer 116 receives the output $S_{14}$ of the β-direction calculation section 417 and outputs a vehicle detection result $S_6$ in accordance with the first embodiment. Thus, by referring to the above lane 1 detection result $S_9$ and the lane 2 detection result $S_{10}$ when a traveling vehicle is detected by the vehicle detection section 124 and the vehicle detection result $S_6$ is outputted, it can be determined in which lane the detected vehicle is traveling.

As described above, the vehicle detection apparatus of the fourth embodiment according to the present invention has the microphone array 402 comprising M number of microphones arranged in the form of a matrix in one plane in the sound collector 3 and has the noise component matrix calculation section 122 which is connected to the above M number of microphones in the microphone array 402 in the substantial part of the detection apparatus which comprises the CPU 4, the memory 5 and the arithmetic circuit 11. In the noise component matrix calculation section 122, the outputs of the above M number of microphones are amplified by the amplifiers 103, the outputs of the amplifiers 103 are sampled periodically with a certain time window in the waveform samplers 104, frequency analyses are conducted in the frequency analyzers 105 to calculate complex amplitude matrices for the above frequencies, correlation matrices are calculated from the above complex amplitude matrices in the correlation matrix calculator 107, the eigenvectors of the above correlation matrices are calculated in the eigenvector calculator 108, and noise component matrices corresponding to the noise components in the outputs of the above M number of microphones are calculated in the noise component matrix calculator 109.

Further, the above substantial part of the detection apparatus also has the α-direction calculation section 410 which is connected to the noise component matrix calculation section 122. In the α-direction calculation section 410, the direction corresponding to the apparent α direction from the microphone array 402 is set in the α-direction setting device 406, the direction corresponding to the apparent β direction from the microphone array 402 is set in the β-direction setting device 407, a direction control vector is calculated in the direction control vector calculator 405, α-direction powers are calculated from the above direction control vector and the above noise component matrices in the direction-specific power calculator 404, the average of the above α-direction powers with respect to the time windows is calculated in the time averaging device 408, and the result can be outputted as the estimated a direction.

Meanwhile, the above substantial part of the detection apparatus also has the β-direction calculation section 417 which is connected to the noise component matrix calculation section 122. In the β-direction calculation section 417, the direction corresponding to the apparent a direction from the microphone array 402 is set in the α-direction setting device 413, the direction corresponding to the apparent β direction from the microphone array 402 is set in the β-direction setting device 414, a direction control vector is calculated in the direction control vector calculator 412, β-direction powers are calculated from the above direction control vector and the above noise component matrices in the direction-specific power calculator 411, the average of the above β-direction powers with respect to the time windows is calculated in the time averaging device 415, and the result can be outputted as the estimated β direction.

Further, the above substantial part of the detection apparatus also has the lane detection section 312 which is connected to the α-direction calculation section 410 in accordance with the first embodiment. In the lane detection section 312, the output α of the α-direction calculation section 410 is inputted to the lane 1 direction counter 307 and the lane 2 direction counter 308 and stored therein for a certain period of time. Of the stored outputs α, the numbers of those between the preset upper limits and lower limits in the α direction of the lane 1 direction and the lane 2 direction can be outputted as the lane 1 detection result and the lane 2 detection result, respectively. Further, since the above substantial part of the detection apparatus also has the vehicle detection section 124 which is connected to the β-direction calculation section 417 in accordance with the first embodiment, the location in the vehicle traveling direction of a vehicle can be detected by the outputs of the M number of microphones.

Thus, by the installation of the microphone array 402 comprising M number of microphones arranged in the form of a matrix in one plane, the location in the vehicle traveling direction and the lane direction of a vehicle can be detected.

[Fifth Embodiment]

Figure 14:
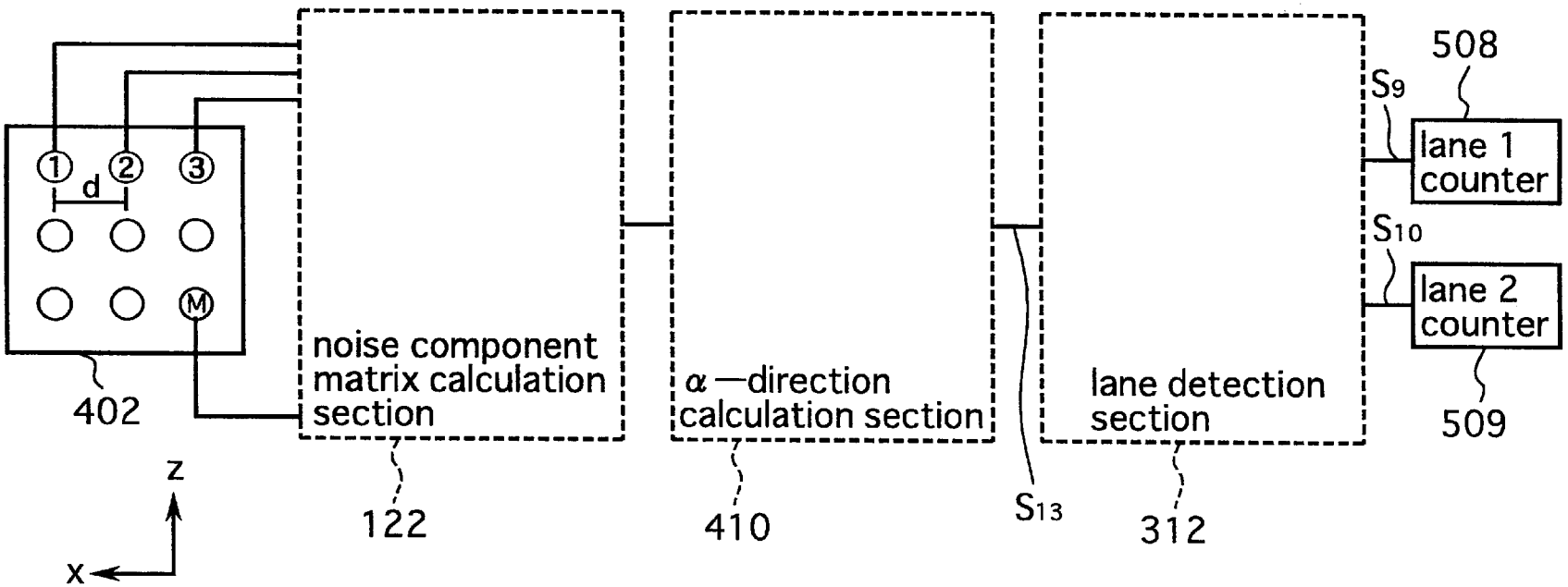
FIG. 14 is a block diagram showing the substantial part of the vehicle detection apparatus of the fifth embodiment according to the present invention.

FIG. 14 shows the substantial part of the vehicle detection apparatus of the fifth embodiment according to the present invention. Since the configuration of the whole vehicle detection apparatus is generally the same as that of the first embodiment, FIG. 1 is used, and the same constituents as those in the first embodiment are referred to by the same numerals and symbols and will not be described.

The present embodiment is different from the first embodiment in that a microphone array 402 comprising M number of microphones arranged in the form of a matrix in one plane is used in place of the microphone array (102 in FIG. 2) comprising M number of microphones aligned in the x-axis direction (fourth embodiment). Further, the present embodiment is also different from the first embodiment in that an α-direction calculation section 410 is provided in place of the β-direction calculation section (123 in FIG. 2) (third embodiment) and that an α-direction setting device 406, a β-direction setting device 407, a direction control vector calculator 405, a direction-specific power calculator 404 and a time averaging device 408 are provided in the α-direction calculation section 410. Still further, the present embodiment is also different from the first embodiment in that a lane detection section 312 is provided in place of the vehicle detection section (124 in FIG. 2) (third embodiment) and that a lane 1 direction counter 307, a lane 2 direction counter 308 and passing judging devices 309 and 310 are provided in the lane detection section 312. Still further, the present embodiment is also different from the third embodiment in that a lane 1 counter 508 and a lane 2 counter 509 which are connected to the lane detection section 312 are provided. According to this configuration, there can be obtained the effect of counting the number of passing vehicles for each lane.

Next, a vehicle detection method based on the above vehicle detection apparatus 100 will be described.

Figure 15:
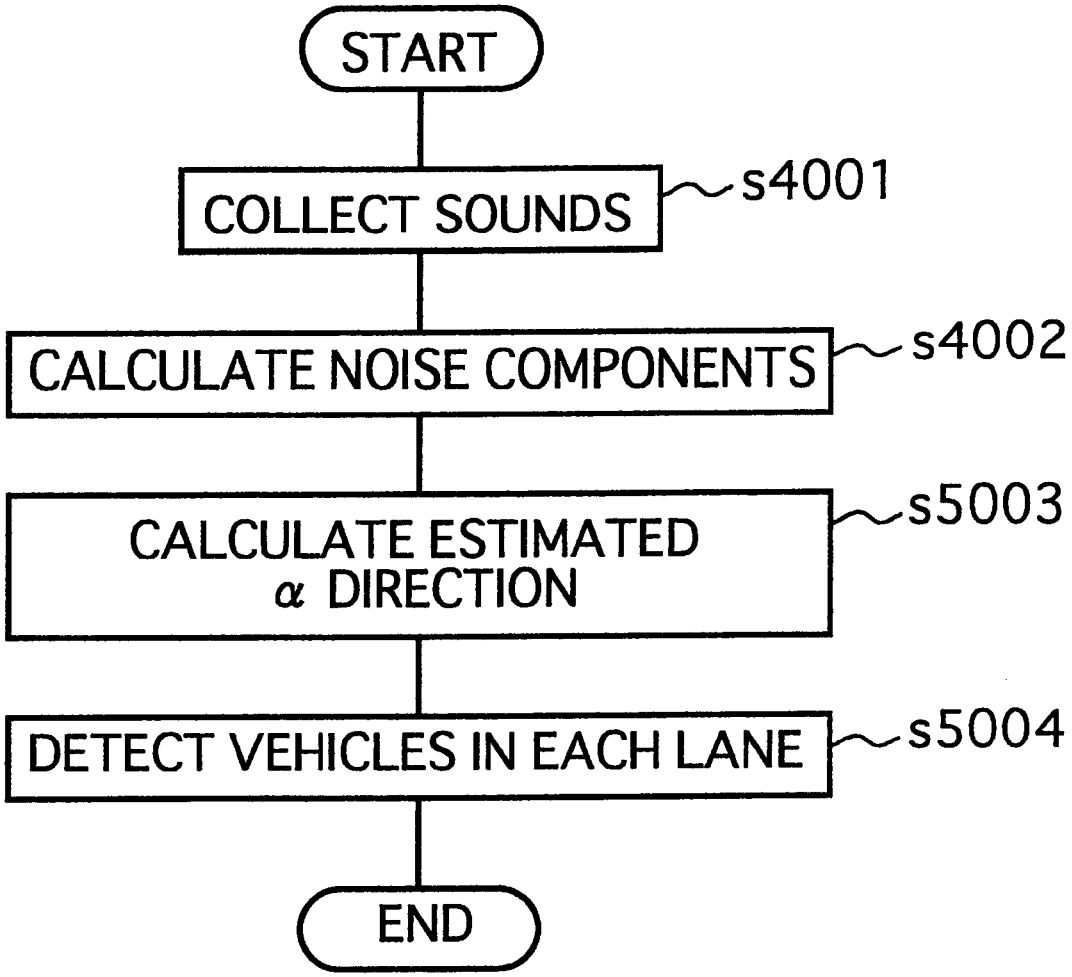
FIG. 15 is a flow chart showing the vehicle detection method of the fifth embodiment according to the present invention.
Figure 16:
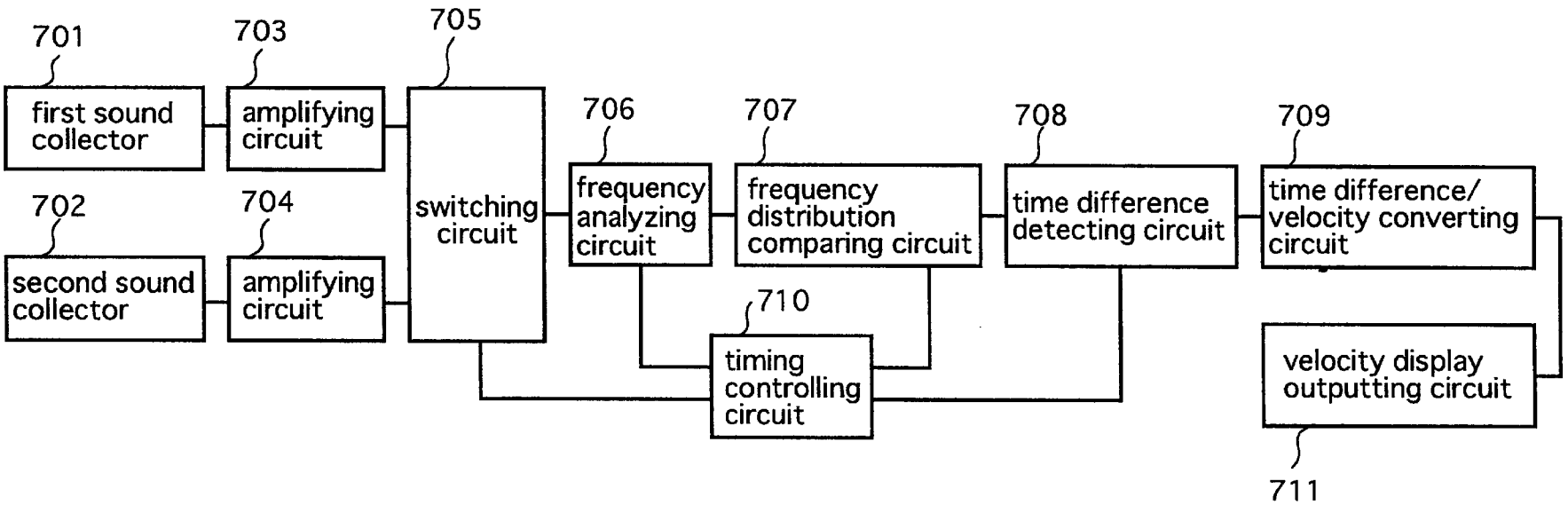
FIG. 16 PRIOR ART
FIG. 16 is a block diagram showing the substantial part of a conventional vehicle detection apparatus.

FIG. 15 shows the vehicle detection method of the fifth embodiment according to the present invention. This is different from that of the first embodiment in that the sound collection step (s4001) and noise component calculation step (s4002) of the fourth embodiment are provided in place of the sound collection step (s1001 in FIG. 4) and the noise component calculation step (s1002 in FIG. 4), that an estimated α direction calculation step (s5003) is provided in place of the estimated β direction calculation step (s1003 in FIG. 4) and that a lane-specific vehicle detection step (s5004) is provided in place of the vehicle detection step (s1004 in FIG. 4). According to this method, there can be obtained the effect of counting passing vehicles for each lane in the lane-specific vehicle detection step (s5004).

In the sound collection step (s4001), in accordance with the fourth embodiment, the microphone array 402 comprising M number of microphones arranged in the form of a matrix in one plane is controlled by the above input control section 1 to collect the noises produced by the vehicles and the like on the road having a lane 1 and a lane 2, and the outputs of the above M number of microphones are inputted to and amplified by the amplifiers 103 in the noise component matrix calculation section 122.

In the noise component calculation step (s4002), after the outputs of the microphone array 402 are amplified by the amplifiers 103, a noise component matrix Rn[m,m] is calculated in and outputted from the noise component matrix calculation section 122 in accordance with the first and fourth embodiments. The output of the noise component matrix calculation section 122 is inputted to the α-direction calculation section 410.

In the estimated a direction calculation step (s5003), in the α-direction calculation section 410, in accordance with the fourth embodiment, the direction control vector calculator 405 receives the α value set by the α-direction setting device 406 and the β value (fixed value) set by the β-direction setting device 407 and outputs a direction control vector $S_{11}$, the direction-specific power calculator 411 receives the above direction control vector $S_{11}$ and the output of the noise component matrix calculation section 122 and calculates a direction-specific power, and the time averaging device 415 receives the output (direction-specific power) of the direction-specific power calculator 411 and outputs an estimated α direction $S_{13}$. As described above, by scanning the α with the β fixed, the estimated a direction $S_{13}$ can be calculated.

In the lane-specific vehicle detection step (s5004), the lane detection section 312 receives the output (estimated α direction) $S_{13}$ of the α-direction calculation section 410 and outputs a lane 1 detection result $S_9$ and a lane 2 detection result $S_{10}$ in accordance with the fourth embodiment.

Then, the lane 1 counter 508 receives the output (lane 1 detection result) $S_9$ of the lane detection section 312 and counts the number of passing vehicles for the lane 1. Meanwhile, the lane 2 counter 509 receives the output (lane 2 detection result) $S_{10}$ of the lane detection section 312 and counts the number of passing vehicles for the lane 2.

As described above, the vehicle detection apparatus of the fifth embodiment according to the present invention has the lane 1 counter 508 and the lane 2 counter 509 which are connected to the lane detection section 312 in the substantial part of the detection apparatus The lane 1 counter 508 and the lane 2 counter 509 receive the location in the lanes of a vehicle which is detected in the lane detection section 312 and can count the number of passing vehicles (number of detected vehicles) for each lane.

Further, although there has been described in the above embodiments the case where a method based on template matching is employed as the method for calculating the distance in the distance calculators 117 and 206, the same effect can still be obtained even when the present invention adopts a method other than the template matching-based method, such as a method based on known DP (Dynamic Program) matching.

The sound collector 3 comprising the above microphone array 102, 302 or 402 constitutes the above sound collection means; the CPU 4, memory 5, arithmetic circuit 11 and the like which include the noise component matrix calculation section (β-direction noise component matrix calculation section) 122, the α-direction noise component matrix calculation section 303, the α-direction calculation sections 305 and 410 and the β-direction calculation sections 123 and 417 constitute the above direction estimation means; the CPU 4, memory 5, arithmetic circuit 11 and the like which include the vehicle detection section 124, the vehicle and velocity detection section 214 and the lane detection section 312 constitute the above similarity calculation means; the CPU 4, memory 5, arithmetic circuit 11 and the like which include the α-direction calculation sections 305 and 410 and the β-direction calculation sections 123 and 417 constitute the above estimation means; the lane 1 direction counter 307 and the lane 2 direction counter 308 constitute the counter or the first counter; the lane 1 counter 508 and the lane 2 counter 509 constitute the second counter, the passing judging devices 309 and 310 constitute the above vehicle location detection means; the estimated direction buffers 116 and 205 and the distance calculators 117 and 206 constitute the above comparison means; and the time base expander 208 constitutes the above time base expansion means. Further, the noise component calculation step (s1002), the αβ-direction noise component calculation step (s3002), the estimated β-direction calculation section (s1003), estimated αβ-direction calculation sections (s3003 and s4003) and the estimated α-direction calculation section (s5003) are included in the above direction estimation step.

As described above, the present invention can provide a vehicle detection apparatus and a vehicle detection method which exhibit the excellent effects of detecting a sound source even when a plurality of vehicles are traveling simultaneously or when there are noises produced from something other than the desired vehicle and calculating the location in the vehicle traveling direction and the lane direction of the sound source and the number of passing vehicles by sampling the time signals from a sound collection means comprising a plurality of microphones and placed in the vicinity of a road periodically with time windows, estimating the direction of a sound source in each time window and calculating the degree of similarity between the estimation results and a plurality of templates which indicate a change in the direction of the sound source with time while the vehicle is traveling.

What is claimed is:

1. A vehicle detection apparatus comprising a sound collection means placed in the vicinity of a road and comprising a plurality of microphones; a direction estimation means for sampling the input signals from the sound collection means periodically with time windows and estimating the direction of a sound source in each time window; and a similarity calculation means for calculating the degree of similarity between the estimation results by the direction estimation means and a plurality of templates which indicate a change in the direction of the sound source with time while the vehicle is traveling.

2. The vehicle detection apparatus as set forth in claim 1, wherein the sound collection means comprises a plurality of microphones aligned on a line parallel to the vehicle traveling direction.

3. The vehicle detection apparatus as set forth in claim 1, wherein the sound collection means comprises a plurality of microphones aligned on a line parallel to the vehicle traveling direction and a plurality of microphones aligned on a line perpendicular to the vehicle traveling direction.

4. The vehicle detection apparatus as set forth in claim 3, wherein the direction estimation means comprises an estimation means for estimating the direction in the vehicle traveling direction and the lane direction of the sound source.

5. The vehicle detection apparatus as set forth in claim 4, which comprises counters for counting the estimation results by the direction estimation means for each lane and a lane detection means for detecting the location in the lanes of the sound source based on the counting values of these counters, when the road has a plurality of lanes.

6. The vehicle detection apparatus as set forth in claim 1, wherein the sound collection means comprises a plurality of microphones arranged in the form of a matrix in the same plane.

7. The vehicle detection apparatus as set forth in claim 6, wherein the direction estimation means comprises an estimation means for estimating the direction in the vehicle traveling direction and the lane direction of the sound source two-dimensionally.

8. The vehicle detection apparatus as set forth in claim 7, wherein the direction estimation means comprises an estimation means for estimating the direction of the sound source by scanning in the vehicle traveling direction with the direction of the sound source in the lane direction limited to the center of the road.

9. The vehicle detection apparatus as set forth in claim 7, wherein the direction estimation means comprises an estimation means for estimating the direction of the sound source by scanning in the lane direction with the direction of the sound source in the vehicle traveling direction limited.

10. The vehicle detection apparatus as set forth in claim 7, which further comprises a first counter which counts the estimation results by the direction estimation means for each lane, a lane location detection means for detecting the location in the lanes of the sound source based on the counting values of the counter, and a second counter which counts the detection results by the lane location detection means for each lane, when the road has a plurality of lanes.

11. The vehicle detection apparatus as set forth in any one of claims 1 to 10, wherein the similarity calculation means comprises a comparison means for comparing the plurality of templates with the estimation results.

12. The vehicle detection apparatus as set forth in claim 11, wherein the plurality of templates are prepared by using the sound of a vehicle when the vehicle is caused to travel at different velocities.

13. The vehicle detection apparatus as set forth in claim 11, wherein the plurality of templates are prepared by expanding or contracting the time base of a template prepared by using the sound of a vehicle traveling at a constant speed, and the similarity calculation means comprises a time base expansion means for expanding or contracting the time base of the template.

14. The vehicle detection apparatus as set forth in any one of claims 1 to 10, wherein the sound collection means comprises a plurality of microphones the number of which is equal to or greater than "number of assumed sound sources+1".

15. A vehicle detection method comprising a sound collection step in which the noises produced by a traveling vehicle are collected by a plurality of microphones placed in the vicinity of a road; a direction estimation step in which the input signals from the plurality of microphones are sampled periodically with time windows and the direction of a sound source is estimated in each time window; and a similarity calculation step in which the degree of similarity between the estimation results by the direction estimation step and templates which indicate a change in the direction of the sound source with time while the vehicle is traveling is calculated.

16. A vehicle detection method comprising a sound collection step in which the noises produced by a traveling vehicle are collected by a plurality of microphones aligned on a line parallel to the vehicle traveling direction and placed in the vicinity of a road; a direction estimation step in which the input signals from the plurality of microphones are sampled periodically with time windows and the direction of a sound source is estimated in each time window; and a vehicle detection step in which the degree of similarity between the estimation results by the direction estimation step and a plurality of templates which indicate a change in the direction of the sound source with time while the vehicle is traveling is calculated and the vehicle is detected based on the result of the calculation.

17. A vehicle detection method comprising a sound collection step in which the noises produced by a traveling vehicle are collected by a plurality of microphones aligned on a line parallel to the vehicle traveling direction and on a line perpendicular to the vehicle traveling direction and placed in the vicinity of a multi-lane road; a direction estimation step in which the input signals from the plurality of microphones are sampled periodically with time windows and the direction in the vehicle traveling direction and the lane direction of a sound source is estimated in each time window; a vehicle detection step in which the degree of similarity between the estimation results in the vehicle traveling direction by the direction estimation step and a plurality of templates which indicate a change in the direction of the sound source with time while the vehicle is traveling is calculated and the vehicle is detected based on the result of the calculation; and a lane detection step in which the estimation results in the lane direction by the direction estimation step are counted for each lane and the location in the lanes of the sound source is detected based on the counting values.

18. A vehicle detection method comprising a sound collection step in which the noises produced by a traveling vehicle are collected by a plurality of microphones arranged in the form of a matrix in the same plane and placed in the vicinity of a multi-lane road; a direction estimation step in which the input signals from the plurality of microphones are sampled periodically with time windows and the direction in the vehicle traveling direction and the lane direction of a sound source is estimated in each time window; a vehicle detection step in which the degree of similarity between the estimation results in the vehicle traveling direction by the direction estimation step and a plurality of templates which indicate a change in the direction of the sound source with time while the vehicle is traveling is calculated and the vehicle is detected based on the result of the calculation; and a lane detection step in which the estimation results in the lane direction by the direction estimation step are counted for each lane and the location in the lanes of the sound source is detected based on the counting values.

19. The vehicle detection method as set forth in claim 18, wherein in the direction estimation step, the direction of the sound source is estimated by scanning in the vehicle traveling direction with the direction of the sound source in the lane direction limited to the center of the road.

20. The vehicle detection method as set forth in claim 18, wherein in the direction estimation step, the direction of the sound source is estimated by scanning in the lane direction with the direction of the sound source in the vehicle traveling direction limited.

21. A vehicle detection method as set forth in claim 18, further comprising a lane-specific vehicle detection step in which a number of the vehicles detected by the vehicle detection step is counted for each lane detected by the lane detection step.

22. The vehicle detection method as set forth in claim 21, wherein in the direction estimation step, the direction of the sound source is estimated by scanning in the lane direction with the direction of the sound source in the vehicle traveling direction limited.

23. The vehicle detection method as set forth in any one of claims 15 to 22, wherein in the vehicle detection step, the degree of similarity between the templates prepared by using the sounds of a vehicle traveling at different velocities and the estimation results is calculated.

24. The vehicle detection method as set forth in any one of claims 15 to 22, wherein the vehicle detection step further comprises a velocity detection step in which the degree of similarity between the templates prepared by expanding or contracting the time base of a template prepared by using the sounds of a vehicle traveling at a constant speed and the estimation results is calculated and, according to the result of the calculation, the velocity of the detected vehicle is calculated from the expansion ratio of the template and the vehicle velocity used for preparing the template.

25. The vehicle detection method as set forth in any one of claims 15 to 22, wherein template matching is used for calculating the degree of similarity between the templates and the estimation results.

26. The vehicle detection method as set forth in any one of claims 15 to 22, wherein DP matching is used for calculating the degree of similarity between the templates and the estimation results.

27. The vehicle detection method as set froth in any one of claims 15 to 22, wherein the number of the plurality of microphones is equal to or greater than "number of assumed sound sources+1".

* * * * *

UNITED STATES PATENT AND TRADEMARK OFFICE

CERTIFICATE OF CORRECTION

PATENT NO. : 6,504,490 B2
DATED : January 7, 003
INVENTOR(S) : Koichiro Mizushima It is certified that error appears in the above-identified patent and that said Letters Patent is hereby corrected as shown below:

Column 10,
Line 6, please delete "P", and insert therefor -- β --.

Column 23,
Line 58, please delete "$]^{\tau}$ ", and insert therefor -- $]^{T}$ --.

Column 24,
Line 28, please delete "a direction", and insert therefor -- α direction --.

Column 25,
Line 46, please delete "a direction", and insert therefor -- α direction --.

Column 27,
Line 26, please delete "a direction", and insert therefor -- α direction --.

Signed and Sealed this

Tenth Day of June, 2003

JAMES E. ROGAN
*Director of the United States Patent and Trademark Office*